US012805612B2

(12) United States Patent
Albert et al.

(10) Patent No.: US 12,805,612 B2
(45) Date of Patent: Nov. 24, 2026

(54) TAMPER-RESISTANT WEARABLE BAND

(71) Applicant: Invisalert Solutions, Inc., West Chester, PA (US)

(72) Inventors: Jonathan D. Albert, Philadelphia, PA (US); Peter A. Nagy, Newtown Square, PA (US)

(73) Assignee: Invisalert Solutions, Inc., West Chester, PA (US)

( * ) Notice: Subject to any disclaimer, the term of this patent is extended or adjusted under 35 U.S.C. 154(b) by 217 days.

(21) Appl. No.: 18/686,348

(22) PCT Filed: Aug. 23, 2022

(86) PCT No.: PCT/US2022/075350
§ 371 (c)(1),
(2) Date: Feb. 23, 2024

(87) PCT Pub. No.: WO2023/028487
PCT Pub. Date: Mar. 2, 2023

(65) Prior Publication Data

US 2026/0123719 A1 May 7, 2026

Related U.S. Application Data

(60) Provisional application No. 63/236,181, filed on Aug. 23, 2021.

(51) Int. Cl.
*A44C 5/18* (2006.01)
*A44B 11/06* (2006.01)
*A44C 5/20* (2006.01)

(52) U.S. Cl.
CPC ..... *A44C 5/2019* (2013.01); *A44B 11/06* (2013.01)

(58) Field of Classification Search
CPC ..... A44C 5/00; A44C 5/0015; A44C 5/0053; A44C 5/185; A44C 5/2019; A44C 5/2066; A44C 5/2071; A44B 11/00; A44B 11/006; A44B 11/06; A44B 11/10; A44B 11/25; Y10T 24/4084; Y10T 24/4086; Y10T 24/4019; Y10T 24/40; Y10T 24/4079;
(Continued)

(56) References Cited

U.S. PATENT DOCUMENTS 706,080 A * 8/1902 Mitchell ..... A44B 11/10 24/171
5,077,666 A 12/1991 Brimm et al.
(Continued)

FOREIGN PATENT DOCUMENTS

GB 2426180 A 11/2006
GB 2549099 A 10/2017
(Continued)

OTHER PUBLICATIONS

Nagy; U.S. Appl. No. 18/826,171 entitled "Patient safety monitoring method and apparatus," filed Sep. 5, 2024.
(Continued)

*Primary Examiner* — Jack W Lavinder
(74) *Attorney, Agent, or Firm* — Shay Glenn LLP

(57) ABSTRACT

Various apparatuses for a tamper-resistant wearable band are disclosed. In some examples, a tamper-resistant wearable band may include a flexible strap and a. tamper-resistant clasp. The clasp may irreversibly anchor the ends of the flexible strap.

22 Claims, 18 Drawing Sheets

(58) Field of Classification Search
CPC ..... Y10T 24/45194; Y10T 24/4093; Y10T 24/4014; G09F 3/005
See application file for complete search history.

(56) References Cited

U.S. PATENT DOCUMENTS 5,218,344 A 6/1993 Ricketts
5,298,884 A 3/1994 Gilmore et al.
5,566,427 A * 10/1996 Lathrop ..... A44B 11/06 24/169
5,769,290 A 6/1998 Pestana
5,979,095 A * 11/1999 Schneider ..... G09F 3/005 40/633
6,225,906 B1 5/2001 Shore
6,406,426 B1 6/2002 Reuss et al.
6,693,543 B1 2/2004 Stephenson et al.
D507,798 S 7/2005 Jewitt et al.
6,954,148 B2 10/2005 Pulkkinen et al.
7,154,397 B2 12/2006 Zerhusen et al.
7,242,306 B2 7/2007 Wildman et al.
7,382,247 B2 6/2008 Welch et al.
D577,364 S 9/2008 Flynt et al.
7,450,015 B2 11/2008 Singer et al.
D588,152 S 3/2009 Okada
D588,153 S 3/2009 Okada
7,541,935 B2 6/2009 Dring et al.
7,570,152 B2 8/2009 Smith et al.
D599,363 S 9/2009 Mays
D607,001 S 12/2009 Ording
7,642,290 B2 1/2010 Kaplan
D614,641 S 4/2010 Viegers et al.
7,764,167 B2 7/2010 Reeves et al.
7,825,794 B2 11/2010 Janetis et al.
D643,436 S 8/2011 Lemay
D656,157 S 3/2012 Khan et al.
D656,503 S 3/2012 Brierley et al.
D682,262 S 5/2013 Akana et al.
8,605,094 B1 12/2013 Alfaro et al.
D701,229 S 3/2014 Lee
D701,521 S 3/2014 Kim et al.
D715,820 S 10/2014 Rebstöck
D718,779 S 12/2014 Hang Sik et al.
D720,766 S 1/2015 Mandal et al.
D724,603 S 3/2015 Williams et al.
8,984,436 B1 3/2015 Tseng et al.
9,064,391 B2 6/2015 Vardi et al.
D765,110 S 8/2016 Liang
D789,956 S 6/2017 Ortega et al.
D797,133 S 9/2017 Marcolongo et al.
9,928,713 B2 3/2018 Baczuk et al.
D820,850 S 6/2018 Tekamp et al.
10,410,498 B2 9/2019 Coke et al.
D861,719 S 10/2019 Van Der Molen
D866,586 S 11/2019 Suter et al.
10,482,753 B2 11/2019 Nelson et al.
D873,278 S 1/2020 Nakahara et al.
D875,767 S 2/2020 Farnan et al.
D892,151 S 8/2020 Pontious
D906,359 S 12/2020 Nagy et al.
10,896,590 B2 1/2021 Nagy et al.
11,210,918 B2 12/2021 Nagy et al.
11,682,283 B2 6/2023 Nagy et al.
11,688,265 B1 6/2023 Aquino et al.
2002/0060630 A1 5/2002 Power
2002/0196147 A1 12/2002 Lau
2004/0010720 A1 1/2004 Singh et al.
2005/0094205 A1 5/2005 Lo et al.
2005/0280546 A1 12/2005 Ganley et al.
2007/0118813 A1 5/2007 Forstall et al.
2007/0129983 A1 6/2007 Scherpbier et al.
2007/0267475 A1 11/2007 Hoglund et al.
2008/0012767 A1 1/2008 Caliri et al.
2008/0015903 A1 1/2008 Rodgers
2008/0027288 A1 1/2008 Renz
2008/0141506 A1* 6/2008 Langtry ..... A44B 11/10 24/614
2009/0019890 A1 1/2009 Kirknoff
2009/0075694 A1 3/2009 Kim et al.
2009/0299827 A1 12/2009 Puri et al.
2010/0026510 A1 2/2010 Kiani et al.
2010/0066541 A1 3/2010 Craine
2010/0090971 A1 4/2010 Choi et al.
2010/0201821 A1 8/2010 Niem et al.
2010/0217618 A1 8/2010 Piccirillo et al.
2010/0249540 A1 9/2010 Lisogurski
2010/0253521 A1 10/2010 Williams, Sr. et al.
2011/0061212 A1* 3/2011 Piermayr ..... A44B 11/04 24/265 R
2011/0082808 A1 4/2011 Beykpour et al.
2011/0105854 A1 5/2011 Kiani et al.
2011/0109461 A1 5/2011 Aninye
2011/0179387 A1 7/2011 Shaffer et al.
2011/0191124 A1 8/2011 Sung et al.
2011/0197163 A1 8/2011 Jegal et al.
2012/0016691 A1 1/2012 Sievenpiper et al.
2012/0095822 A1 4/2012 Chiocchi
2012/0130730 A1 5/2012 Setlur et al.
2012/0154582 A1 6/2012 Johnson et al.
2012/0184207 A1 7/2012 Gaines et al.
2013/0018673 A1 1/2013 Rubin
2013/0097824 A1* 4/2013 Chadwick ..... G09F 3/005 24/587.12
2013/0110565 A1 5/2013 Means, Jr. et al.
2013/0132908 A1 5/2013 Lee et al.
2013/0145663 A1 6/2013 Greer
2013/0218583 A1 8/2013 Marcolongo et al.
2013/0226607 A1 8/2013 Woody et al.
2013/0227486 A1 8/2013 Brinda
2013/0234853 A1 9/2013 Kazerouni
2014/0067770 A1 3/2014 Cheong et al.
2014/0184408 A1 7/2014 Herbst et al.
2014/0189608 A1 7/2014 Shuttleworth et al.
2014/0222462 A1 8/2014 Shakil et al.
2014/0274115 A1 9/2014 Michalson et al.
2014/0283142 A1 9/2014 Shepherd et al.
2015/0084769 A1 3/2015 Messier et al.
2015/0154379 A1 6/2015 Cvijanovich et al.
2015/0170504 A1 6/2015 Jooste
2015/0242665 A1 8/2015 Antonescu et al.
2015/0264647 A1 9/2015 Lacatus et al.
2016/0026837 A1 1/2016 Good et al.
2016/0071393 A1 3/2016 Kaplan et al.
2016/0078752 A1 3/2016 Vardi
2016/0109853 A1 4/2016 Kobayashi
2016/0239778 A1 8/2016 Suneja
2016/0253470 A1 9/2016 Marcolongo et al.
2017/0032093 A1 2/2017 Norton et al.
2017/0116560 A1 4/2017 Wickstrom et al.
2017/0224063 A1* 8/2017 Chadwick ..... A44B 99/00
2017/0243056 A1 8/2017 Cheng et al.
2017/0243469 A1 8/2017 Vega et al.
2018/0041944 A1 2/2018 Korneluk et al.
2018/0065248 A1 3/2018 Barral
2018/0165937 A1 6/2018 Devdas et al.
2018/0233225 A1 8/2018 Experton et al.
2018/0369039 A1 12/2018 Bhimavarapu et al.
2019/0018719 A1 1/2019 Brin
2019/0034592 A1 1/2019 Gupta et al.
2019/0043337 A1 2/2019 Liu et al.
2019/0050557 A1 2/2019 Martin et al.
2019/0146550 A1 5/2019 Berardinelli
2019/0260741 A1 8/2019 Ashok et al.
2019/0320898 A1 10/2019 Dirghangi et al.
2020/0074099 A1 3/2020 Felice-Steele et al.
2020/0137357 A1 4/2020 Kapoustin et al.
2020/0201260 A1 6/2020 Rodriguez et al.
2020/0357502 A1 11/2020 Lee et al.
2021/0125709 A1 4/2021 Qian et al.
2021/0287783 A1 9/2021 Jhaveri
2021/0289319 A1 9/2021 Antony et al.
2022/0189641 A1 6/2022 Staples
2022/0189644 A9 6/2022 Barnes et al.
2022/0240779 A1 8/2022 Peyman

(56) References Cited

U.S. PATENT DOCUMENTS

| | | | |
|---|---|---|---|
| 2022/0301407 | A1 | 9/2022 | Nagy et al. |
| 2022/0327360 | A1 | 10/2022 | Merlin et al. |
| 2022/0328180 | A1 | 10/2022 | Chelles et al. |
| 2023/0019901 | A1 | 1/2023 | Muhsin et al. |
| 2023/0350004 | A1 | 11/2023 | Cnaan-On et al. |
| 2024/0046768 | A1 | 2/2024 | Nagy et al. |
| 2024/0404391 | A1 | 12/2024 | Nagy et al. |
| 2025/0054378 | A1 | 2/2025 | Nagy |
| 2025/0140096 | A1 | 5/2025 | Nagy et al. |
| 2026/0141798 | A1 | 5/2026 | Nagy et al. |

FOREIGN PATENT DOCUMENTS

| | | | |
|---|---|---|---|
| KR | 10-1515597 | B1 | 4/2015 |
| KR | 10-2023-0030962 | A | 3/2023 |
| WO | WO02/082348 | A2 | 10/2002 |
| WO | WO2016/102506 | A1 | 6/2016 |
| WO | WO2023/076950 | A1 | 5/2023 |

OTHER PUBLICATIONS

Welker; U.S. Appl. No. 18/976,319 entitled "Secure mobile device management," filed Dec. 10, 2024.

Nagy et al.; U.S. Appl. No. 18/955,963 entitled "Apparatus and method for monitoring compliance with patient care protocols" filed Nov. 21, 2024.

Consumer Cellular; Huawei 8652—managing contacts; 1 page (Screenshot); retrieved from the internet (https://www.youtube.com/watch?v=oCazslu6NLg on Sep. 17, 2012.

Contacts Like Listview: Contacts like listview—stack overflow; 1 page; retrieved from the internet (http://stackoverflow.com/questions/5017080/contacts-like-listview) on Feb. 16, 2011.

invisalertsolutions.com; 15-minute checks psychiatry inpatient setting; Feb. 16, 2018; 2 pages retrived from the internet (https://www.invisalertsolutions.com/>(year:2018); on Aug. 18, 2020.

Google Drive Blog; Rapid wireframe sketching in google docs; 2pages; retrived from the internet (https://drive.googleblog.com/2010/05/rapid-wireframe-sketching-in-google-docs.htm) on May 2010.

Java; How to add my app icon in contact list of users' android phone—stack overflow; 1 pages retrieved from the internet (https:stackoverflow.com/questions/25029855/how-to-add-my-app-icon-in-contact-list-of-users-android-phone) on Aug. 18, 2020.

Mcnickle; 7 E-Health tools to get patients engaged; 5 pages; retrieved from the internet (http://www.informationweek.com/healthcare/patient-tools/7-e-health-tools-to-get-patients-engaged/d/d-id/1106716) on Oct. 8, 2012.

Pandey; [How-to] Backup your phone contacts to google; 1 page (Screenshot); retrieved from the interent (http://www.youtube.com/watch?v=vZwvc-7CCf4) on Nov. 15, 2012.

Sain Lukes College on Google Play Reviews; Similar play app stats; 1 page; retrived from the internet (https://www.similarplay.com/dublabs/saint_lukes_college/apps/com.dud.app.saintlukes) on Aug. 18, 2020.

Vladleevideo; Quick Contacts for Android, 2 pages (Screenshot); retrieved from the internet (https://www.youtube.com/watch?v=iRn97Neh-cY) on Apr. 18, 2017.

Winarno; How to backup contacts on samsung S4; 1 page (Screenshot); retrieved from the internet (https://www.youtube.com/watch?v=_MN9RbuV9Vc>); on Jul. 7, 2014.

Marcolongo et al.; U.S. Appl. No. 29/550,879, entitled "Graphical user interface for display screen or portion thereof," filed Jan. 7, 2016.

Banja; Preventing sexual attacks in healthcare facilities: Risk management considerations. Journal of healthcare risk management; 33(3); pp. 5-12; Feb. 2014.

NAGY.; U.S. Appl. No. 19/209,782 entitled "Patient safety monitoring method and apparatus," filed May 15, 2025.

Welker; U.S. Appl. No. 19/261,815 entitled "Secure mobile device management", filed Jul. 7, 2025.

* cited by examiner

TAMPER-RESISTANT WEARABLE BAND

CLAIM OF PRIORITY

This application claims priority to U.S. provisional patent application No. 63/236,181, titled "TAMPER-RESISTANT WEARABLE BAND," filed on Aug. 23, 2021, and herein incorporated by reference in its entirety.

INCORPORATION BY REFERENCE

All publications and patent applications mentioned in this specification are herein incorporated by reference in their entirety to the same extent as if each individual publication or patent application was specifically and individually indicated to be incorporated by reference.

BACKGROUND

Various wearable devices are available for a user or patient to wear. For example, some wearable devices allow monitoring of a user's health, determine their location, or the like. Oftentimes, the wearable devices should not be removed except by an authorized person. For example, the wearable device may include a tracking or monitoring device to be worn by a patient or subject as part of a medical or carceral setting. Currently available apparatuses and systems for attaching devices to patient that are difficult for the subject or patient to remove are uncomfortable and overly complex. Further such device may alter the fit (and therefore comfort) when attached to the patient or subject, which may make the device uncomfortably tight or unacceptably loose.

Thus, there exists a need for tamper-resistant wearable devices and in particular for tamper-resistant devices that may be safely and accurately adjusted to fit the patient or subject and secured to the patient or subject without loosening or tightening when locking shut.

SUMMARY OF THE DISCLOSURE

Described herein are apparatuses (e.g., devices, systems etc.) that may be worn by, or affixed to a person. In particular, the apparatuses described herein may include a strap and an irreversibly locking clasp worn about a user's appendage and/or torso and/or neck, that may be tamper-resistant and difficult to remove.

For example, described herein are apparatuses (e.g., systems and devices, including locking straps) and methods of using them for irreversibly securing a tamper-resistant strap to a subject. The methods and apparatuses of this disclosure may each have several innovative aspects, no single one of which may solely be responsible for the desirable attributes disclosed herein.

The tamper-resistant wearable bands described herein may include a flexible strap and an irreversibly locking clasp that may secure the end of the flexible and. One end of the flexible strap may be secured around a bar (e.g., an anchor bar) within the clasp by forming a loop around the bar that is secured back to itself, e.g., by welding, stitching, adhesive, etc. The second end of the flexible strap may be secured within the clasp by passing through a channel within a housing of the clasps and deflecting over a ramp. A locking sled may be advanced into the clasps housing to drive the flexible strap (e.g., the region at or near the second end of the flexible strap) against the ramp. Either or both the path of the strap over the ramp and/or the ramp itself may be changed when engaging the tamper-resistant band to secure the band to the patient/subject. For example, in some cases the ramp (and/or the path) may deform or bend to transition from a first angle (e.g., between 10-45 degrees) to a second angle (between 45-90 degrees, or in some cases >90 degrees) that is larger than the first angle when the locking sled is driven into the housing of the clasp. In some, non-limiting, examples, the ramp may bend or crumple to change the angle, which in turn changes the angle of the flexible within the housing, making it much harder to withdraw. Any of these apparatuses may include one or more teeth, which may be part of the housing, the locking sled, and/or an inner anchor region of the device. For example, the locking sled may include one or more teeth that extend into the housing from the sled and may drive the flexible strap against the ramp, further securing the flexible strap in the housing. The excess portion of the second end of the strap extending out of the housing may be cut off.

For example, described herein are tamper-resistant wearable bands that include: a flexible strap including a first end and a second end; and an irreversibly locking clasp including: an outer housing cover having a first open end opposite a second open end and a channel formed therebetween, wherein the first open end has a larger width than the second open end; an inner anchor and a ramp having a first ramp angle, wherein the first end of the flexile strap is secured to the inner anchor, further wherein the inner anchor is configured to be retained within the outer housing cover so that the ramp faces the first open end of the outer housing; and a locking sled slideably coupled to the outer housing cover at the second open end so that the second end of the flexible strap may pass under the locking sled into the channel of the outer housing cover, over the ramp and out of the second open end, wherein the locking sled comprises one or more teeth; wherein the ramp is configured to be deformed from the first ramp angle to a second ramp angle that is greater than the first ramp angle when the locking sled is slid into the outer housing cover so that the flexible strap may be secured between the locking sled and the inner anchor.

In any of these apparatuses the inner anchor may include an anchor bar to which the first end of the flexible strap is secured (e.g., around the anchor bar). The first end of the flexible strap may be secured around the anchor bar to form a loop in which the first end of the flexible strap is secured to itself by one of adhesives, sewing, heat welding, ultrasonic welding, or a combination thereof. For example, the first end of the flexible strap may be welded to itself around the anchor bar.

The first ramp angle may be 45 degrees or less (e.g., 40 degrees or less, 37 degrees or less, 35 degrees or less, between 10 degrees and 45 degrees, between 10 degrees and 40 degrees, etc.) and the second ramp angle, when deformed (e.g., folded, crumpled, etc.) may be 45 degrees or more (e.g., between 45-90 degrees, between 50-90 degrees, between 55-90 degrees, 50 degrees or more, 55 degrees or more, 60 degrees or more, etc.). In general, the deformation of the ramp may be permanent. Thus, the ramp deformation may include crushing or deflecting the ramp. The ramp itself may be a plurality of ramp extensions (e.g., having spaces or gaps between different extension regions) or it may be a single continuous ramp. The ramp may be flat or curved; if curved, the angle may refer to the average angle or in some examples the maximum angle. The ramp (and/or the inner anchor) may be secured within the housing or it may be movable relative to the inside of the housing of the clasp.

In general, the inner anchor may include one or more end regions (or faces) that engage with a shoulder or other region on or around the second open end, preventing the inner anchor from sliding out of the second open end. Once the locking sled is secured within housing the inner anchor is also prevented from passing through the first open end of the housing.

In any of these apparatuses, the locking sled may be configured to travel in only one direction with respect to the outer housing cover. For example, the locking sled may include a track or guide region and/or the locking sled may include pawls (e.g., flexible pawls) that may be configured to engage with teeth formed in the outer housing cover, which allow it to be advanced into the housing but prevent it from withdrawing out of the housing. The pawl may generally be configured as a rack or pack-and-pinion (e.g., engaging gear teeth) structure.

In some examples the flexible strap is configured to move freely within the clasp and over the ramp until the locking sled is fully inserted into the outer housing cover so that the one or more teeth drive deformation of the ramp (deflecting it as indicated above) and securing the flexible strap between the (deflected or deformed) ramp and the one or more teeth. In some examples the one or more teeth include a single bar or tooth region.

As mentioned, in some examples the ramp comprises a plurality of ramp projections. In any of these examples the ramp may be configured to fold and/or crumple.

Any appropriate material may be used for the strap (e.g., band) and/or the clasp, particularly durable, and rugged materials that may not be broken or torn easily. For example, the flexible strap (e.g., band) may be formed of a woven polyester, a non-woven polyester, a polyamide, a polyolefin, polyolefin laminated fibers, or a combination thereof. The clasp (e.g., one or more of the outer housing cover, inner anchor and locking sled) may each comprise at least one of a polyoxymethylene, a polycarbonate, a polyethylene teraphalate, a polybutylene teraphalate, a polyamide, a polyphenylene ether, or a combination thereof. In some examples the strap (band) may be formed of a woven metal or may include a woven, braided, and/or knit metal material. In some examples, the strap/brand may be formed of one or more laminations, including laminations of mixed materials, and/or a core material that is covered with one or more overlayers, including an extruded overlayer. Although in some examples the entire length of the strap or band is flexible, in some examples it may be beneficial to have regions that are more flexible and less flexible, including region that are relatively rigid (inflexible). For example, the band may be inflexible with just the securing portion or region being flexible. Alternatively or additionally, the band (e.g., strap) may have a constant thickness or in some examples may have a variable thickness, except within the clasp or securing portion or region.

For example, a tamper-resistant wearable band may include: a flexible strap including a first end and a second end; and an irreversibly locking clasp including: an outer housing cover having a first open end opposite a second open end and a channel formed therebetween, wherein the first open end has a larger width than the second open end; an inner anchor including an anchor bar and a ramp having a first ramp angle, wherein the first end of the flexile strap is welded to itself forming a loop around the anchor bar, further wherein the inner anchor is configured to be retained within the outer housing cover so that the ramp faces the first open end of the outer housing, and a locking sled slideably coupled to the outer housing cover at the second open end so that the second end of the flexible strap may pass under the locking sled into the channel of the outer housing cover, pass over the ramp and out of the second open end, wherein the locking sled comprises one or more teeth; wherein the ramp is configured to deform the first ramp angle to a second ramp angle that is greater than the first ramp angle when the locking sled is slid into the outer housing cover so that the locking sled is irreversibly engaged within the housing with the flexible strap compressed between the one or more teeth and the deformed ramp.

Any of these apparatuses (e.g., any of these tamper-resistant wearable bands, which may be devices or systems) may be configured so that they may be secured or locked to the user's appendage (e.g., wrist, arm, leg, ankle, etc.) without changing length during the locking process. These apparatuses may also be configured so that the locking sled is engaged from the opposite end housing (clasps) to which the second, or loose, end of the flexible strap is attached. This configuration may also prevent the locking sled from being pulled loose, and/or may dramatically increase the amount of force that would be needed to break or disrupt the engagement between the locking sled and the housing.

For example, a tamper-resistant wearable band may include: a flexible strap including a first end and a second end; and an irreversibly locking clasp including: an outer housing cover having a first open end opposite a second open end and a channel formed therebetween; an inner anchor and a ramp having a first ramp angle, wherein the first end of the flexile strap is secured to the inner anchor and wherein the flexible strap extends from the inner anchor and out of the first open end, further wherein the inner anchor is configured to be retained within the outer housing cover so that the ramp faces the second open end of the outer housing; one or more teeth positioned opposite the ramp and facing away from the second open end; and a locking sled slideably coupled to the outer housing cover at the first open end so that the second end of the flexible strap may pass into the second open end, over and along the ramp, and through the locking sled; wherein the locking sled is configured to be driven into the outer housing cover from the first open end to drive the flexible strap against the one or more teeth so that a path of the flexible strap changes from an initial angle along the ramp to a larger angle to lock the flexible strap relative to the outer housing cover, further wherein the locking sled is locked between the outer housing cover and the inner anchor.

The path of the flexible strap may be changed from the initial angle to an S-shape path having a reverse curvature (e.g., the angle of the path may be increased to >90 degrees). The one or more teeth may be integrated into the outer housing cover.

As mentioned above any of these apparatuses may be configured so that the length of the flexible strap extending from the second open end of the outer housing cover does not shorten when the locking sled is driven into the outer housing cover to lock the flexible strap relative to the outer housing cover. This may be due in part to the arrangement of the outer housing cover, the locking sled and the inner anchor, relative to the path of the strap. For example, the first end of the strap that is attached (via a loop, e.g. to a bar within the housing) and extends from the first end of the housing may extend around the patient/subject's appendage, and the second end of the strap may be inserted into the second open end of the housing in a continuous manner, so that is extends over the ramp and through the locking sled, then back out of the first end of the housing. The locking sled may be in this unlocked position, inserted into the first end of the housing, but not locked in place yet. In this position, the strap may be freely moved in/out of the housing. Sliding the locking sled into the housing may cause the locking sled to drive a portion of the strap within the housing towards one or more teeth that are positioned within the housing (as part of the housing, part of the inner anchor, and/or a separate element within the housing) and changing the path of the strap so that the angle relative to original ramp angle increases, locking the strap in place without changing the length of the strap extending around the patient/subject's appendage. The locking sled may be locked in position between the inner anchor and/or the housing and/or the one or more teeth.

As mentioned above, in any of these apparatuses, the inner anchor may further comprise an anchor bar and the first end of the flexible strap is secured around the anchor bar. The first end of the flexible strap may be welded to itself around the anchor bar. In some examples the first end of the flexible strap forms a loop in which the first end of the flexible strap is secured to itself by one of adhesives, sewing, heat welding, ultrasonic welding, or a combination thereof.

The initial angle may be 40 degrees or less, and wherein the larger angle may be 45 degrees or more (e.g., >50 degrees, >55 degrees, >60 degrees, >70 degrees, >80 degrees, >90 degrees, etc.). The path taken by the strap when the locking sled is engaged may be s-shaped.

As mentioned, in general, the locking sled may be configured to travel in only one direction with respect to the outer housing cover (e.g., inserted into the housing). For example, The locking sled may include one or more pawls and/or gears for allowing forward movement, but not backward movement. The locking sled may include flexible pawls and/or gears (e.g., rack) configured to engage with teeth formed in the outer housing cover.

In any of these apparatuses the first open end of the housing may have a larger width than the second open end. The flexible strap may be configured to move freely over the ramp until the locking sled is driven into the outer housing cover from the first open end to drive the flexible strap against the one or more teeth.

The ramp may be a solid ramp or may be formed by a plurality of ramp projections. Although, as described above, in some examples the ramp may be changed by engaging the locking sled (e.g., deformed), in some examples the ramp is not deformed, but the pathway taken by the strap relative to the ramp may be changed by the looking sled. For example, the pathway may be changed to increase the relative angle of the path over the ramp, e.g., including the path over the one or more teeth.

In general any appropriate strap material may be used. In particular, the flexible strap may be formed of a woven polyester, a non-woven polyester, a polyamide, a polyolefin, polyolefin laminated fibers, or a combination thereof. The components of the clasp may be formed of any appropriate material. For example, the outer housing cover, inner anchor and/or locking sled may each comprise at least one of a polyoxymethylene, a polycarbonate, a polyethylene teraphalate, a polybutylene teraphalate, a polyamide, a polyphenylene ether, or a combination thereof.

For example, a tamper-resistant wearable band may include: a flexible strap including a first end and a second end; and an irreversibly locking clasp including: an outer housing cover having a first open end opposite a second open end and a channel formed therebetween; an inner anchor including an anchor bar and a ramp having a first ramp angle, wherein the first end of the flexile strap is welded to itself forming a loop around the anchor bar, further wherein the inner anchor is configured to be retained within the outer housing cover so that the ramp faces the second open end of the outer housing; one or more teeth positioned opposite the ramp and facing away from the second open end; and a locking sled slideably coupled to the outer housing cover at the first open end so that the second end of the flexible strap passes over the ramp, through the locking sled and out of the first open end of the outer housing cover; wherein the locking sled is configured to deflect the flexile strap when the locking sled is driven into the outer housing cover so that a path of the flexible strap changes from an initial angle along the ramp to a larger angle to lock the flexible strap relative to the outer housing cover, further wherein the locking sled is locked between the outer housing cover and the inner anchor.

Also described herein are methods of securing a tamper-resistant wearable band around an appendage of a subject, the method comprising: placing a strap of the tamper-resistant wearable band around the subject's appendage using any of these apparatuses. For example, described herein are methods of securing a tamper-resistant wearable band around an appendage of a subject that include: placing a strap of the tamper-resistant wearable band around the subject's appendage, wherein the first end of the strap is secured to an anchor bar within a housing of a clasp of the tamper-resistant wearable band; inserting a second end of the strap into a second opening into the housing of the clasp so that the second end of the strap extends over a ramp within the within the housing at a first angle, through a locking sled that is slidably coupled to the housing, and out of a first opening into the housing of the clasp, and irreversibly securing the strap within the housing of the clasp without changing a length of a portion of the strap extending between the first opening and the second opening by driving the locking sled into the first opening of the housing so that the strap is driven against one or more teeth within the clasp that are positioned opposite the ramp, and so that a path of the strap changes from an initial angle along the ramp to a larger angle, locking the strap relative to the outer housing cover, and locking the locking sled between the outer housing cover and the inner anchor.

In any of the methods described herein, driving the locking sled into the first opening may include engaging with one or more pawls and/or gears on an inside of the housing of the clasp to prevent the locking sled from retracting out of the housing.

Irreversibly securing the strap by driving the locking sled so that the path of the strap changes from the initial angle to a larger angle may include changing the path of the strap to an S-shape path having a reverse curvature. In some examples irreversibly securing the strap by driving the locking sled so that the strap is driven against the one or more teeth comprises driving the strap against one or more teeth that are integrated into the outer housing cover. In some examples irreversibly securing the strap by driving the locking sled so that the path of the strap changes from the initial angle to a larger angle comprises deforming the ramp from the initial angle to a second angle. For example, irreversibly securing the strap by driving the locking sled so that the path of the strap changes from the initial angle to a larger angle may optionally include deforming the ramp from the initial angle to the second angle, wherein the second angle is 45 degrees or more.

For example, a method of securing a tamper-resistant wearable band around an appendage of a subject may include: placing a strap of the tamper-resistant wearable band around the subject's appendage, wherein the first end of the strap is secured to an anchor bar within a clasp of the tamper-resistant wearable band; inserting a second end of the strap into a first opening into a housing of a clasp so that the second end of the strap extends under a locking sled that is slidably coupled to the housing, along a ramp within a channel of the housing, and out of a second opening of the housing; and irreversibly securing the strap within the housing of the clasp by driving the locking sled into the first opening of the housing so that one or more teeth of the locking sled drive the strap against the ramp and deform the ramp from a first angle to a second angle that is greater than the first angle.

As mentioned, in any of these methods, deforming the ramp from the first angle to a second angle may comprise deforming the ramp from a first angle of 40 degrees or less to a second angle of 45 degrees or more. Deforming the ramp may comprise deforming a plurality of ramp portions forming the ramp. In some examples, deforming the ramp comprises folding the ramp and/or crushing or crumpling the ramp.

Driving the locking sled into the first opening may comprise engaging with one or more pawls and/or gears on an inside of the channel that prevent the locking sled from retracting out of the housing.

In general, these methods may include irreversibly securing the strap within the housing by driving the one or more teeth into the strap at an angle of between 70-110 degrees.

One innovative aspect of the subject matter described in this disclosure can be implemented as a tamper-resistant wearable band that may include a flexible strap including a first end and a second end and an irreversibly locking clasp (referred to herein as a clasp). The irreversibly locking clasp may include a housing, an inner anchor configured to anchor the first end of the flexible strap to the housing and a locking sled that is slideably coupled to the housing, wherein the inner anchor and the locking sled are configured to lock and immobilize the second end of the flexible strap. In some examples, the locking sled may include flexible pawls and/or gears configured to engage with teeth formed in the housing. In some other examples, the locking sled may be configured to travel in only one direction with respect to the housing. In still other examples, the flexible strap may be configured to move freely within the irreversibly locking clasp until the locking sled is fully inserted into the housing.

Another innovative aspect of the subject matter described in this disclosure can be implemented in another tamper-resistant wearable band that may include a flexible strap and an irreversibly locking clasp. The irreversibly locking clasp may include a base portion configured to anchor a first end of the flexible strap to the irreversibly locking clasp and a cover portion slideably coupled to the base portion and configured to selectively lock and immobilize a second end of the flexible strap. In some examples the irreversibly locking clasp may be configured to operate in a first state, wherein the flexible strap moves freely within the irreversibly locking clasp and operate in a second state, wherein the flexible strap is locked and immobilized within the irreversibly locking clasp. In some other examples, a position of the cover portion with respect to the base portion determines, at least in part, whether the irreversibly locking clasp is operating in the first state or the second state. In still other examples, the base portion may include a ramp configured to guide the flexible strap and fold in response to pressure from the cover portion and the cover portion may include strap teeth configured to lock and immobilize the second end of the flexible strap.

All of the methods and apparatuses described herein, in any combination, are herein contemplated and can be used to achieve the benefits as described herein.

BRIEF DESCRIPTION OF THE DRAWINGS

A better understanding of the features and advantages of the methods and apparatuses described herein will be obtained by reference to the following detailed description that sets forth illustrative embodiments, and the accompanying drawings of which:

FIG. 15A shows an exploded view of the clasp of the tamper-resistant wearable band. FIG. 15B shows the housing of the clasp; FIG. 15C shows an example of an inner anchor including a ramp and one or more teeth positioned opposite the ramp; and FIG. 15D shows an example of a locking sled of the clasp.

FIG. 16A shows the clasp in the unsecured configuration, in which the strap may move freely. FIG. 16B shows the clasp in the secured configuration in which the strap is locked in place.

DETAILED DESCRIPTION

Disclosed herein are various examples of a tamper-resistant wearable bands. These tamper-resistant wearable bands may be used to attach or affix any feasible device to any feasible part of a patient or subject's body. For example, the tamper-resistant wearable band may affix patient monitoring and/or tracking devices to a patient's arm (e.g., wrist) or leg (e.g., ankle). The tamper-resistant wearable bands described herein may affix, and/or may integrate, tracking devices in psychiatric or for prisoner/incarceration settings.

Figure 1A:
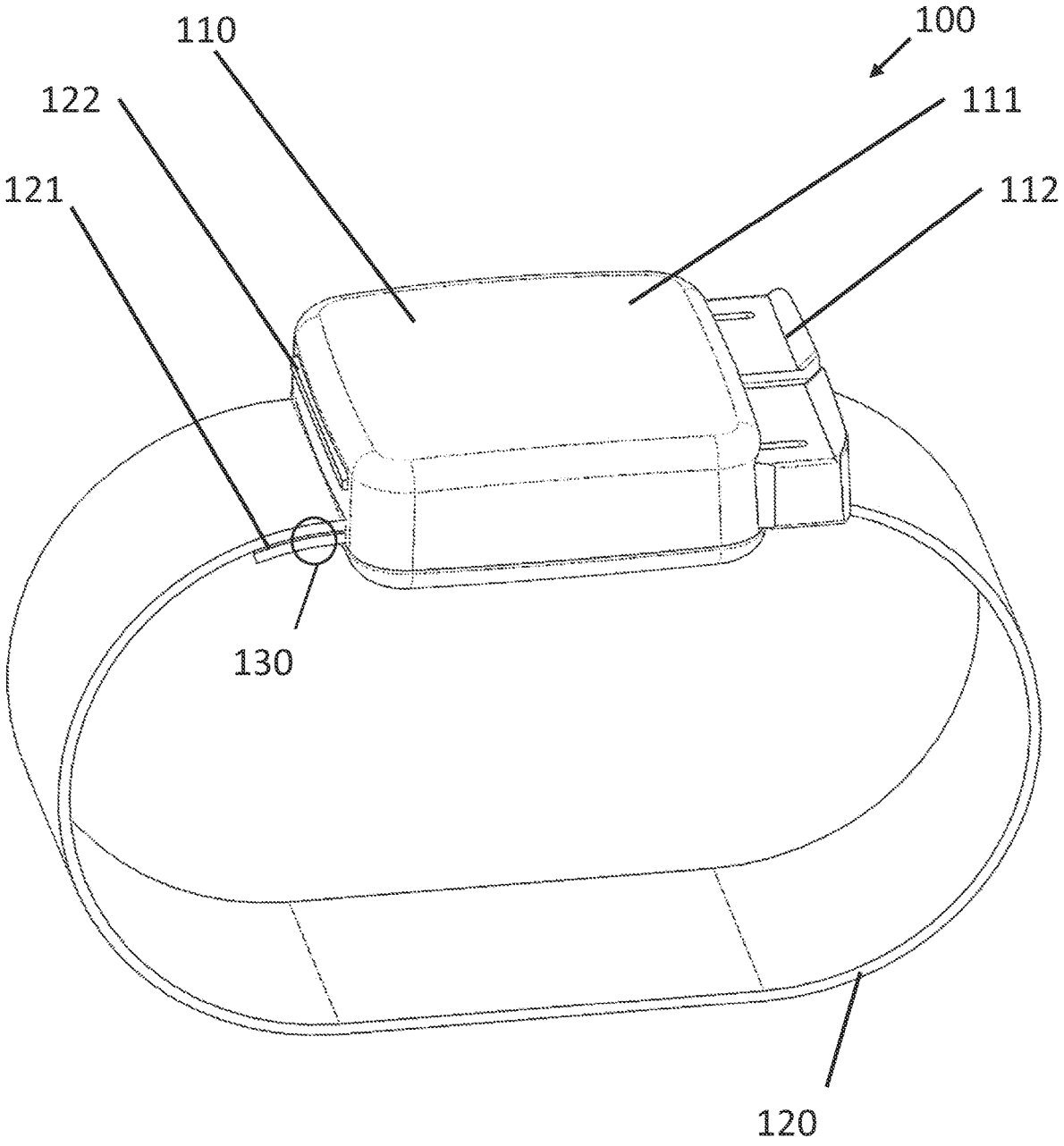
FIG. 1A shows a simplified view of a tamper-resistant wearable band, according to some examples.

FIG. 1A shows a simplified view of a tamper-resistant wearable band 100, according to some examples. The tamper-resistant wearable band 100 may include an irreversibly locking clasp 110 and a strap 120. The clasp 110 may include an outer housing cover 111, a locking sled 112 and a strap anchor (not shown). The strap 120 may include a first end 121 and a second end 122.

The strap 120 may be flexible and formed from and/or include woven (including tightly woven) or non-woven polyester, polyamide, polyolefins, or laminated constructions such as polyolefin laminated fibers, or any other feasible material. The strap 120 may have a length that accommodates the tamper-resistant wearable band 100 to be worn around any desired appendage, or may be worn around a patient's neck, or around the patient's torso (e.g., trunk). As mentioned, the strap may be formed of a woven metal or may include a woven, braided, and/or knit metal material. In some examples, the strap/brand may be formed of one or more laminations, including laminations of mixed materials, and/or a core material that is covered with one or more overlayers, including an extruded overlayer. Although in some examples the entire length of the strap or band is flexible, in some examples it may be beneficial to have regions that are more flexible and less flexible, including region that are relatively rigid (inflexible). For example, the band may be inflexible with just the securing portion or region being flexible. Alternatively or additionally, the band (e.g., strap) may have a constant thickness or in some examples may have a variable thickness, except within the clasp or securing portion or region.

The first end 121 of the strap 120 may be looped around the strap anchor and may be doubled back over itself as shown in region 130. In some examples, the first end 121 of the strap 120 may be mechanically attached to itself in the region 130. For example, the first end 121 may be attached to itself using adhesives, sewing, heat welding, ultrasonic welding, or any other feasible means. The strap anchor is described in more detail below in conjunction with FIGS. 2 and 3A-B.

The locking sled 112 may be slideably coupled to (e.g., may slide within) the outer housing cover 111. For example, the locking sled 112 may be inserted to a first position into the outer housing cover 111. In the first position, the locking sled 112 and the strap anchor may form a first path for the strap 120 that allows the second end 122 of the strap 120 to be inserted into the outer housing cover 111 and guided through the outer housing cover 111 until the second end 122 exits the outer housing cover 111. The first path for the strap 120 is described in more detail below in conjunction with FIGS. 6A-C and 7.

When the locking sled 112 is in the first position, the irreversibly locking clasp 110 is said to be in a first state that allows the strap 120 to be adjusted. That is, the strap 120 may be moved freely through the irreversibly locking clasp 110 to accommodate different sizes of arms, legs, and the like. Unlike some conventional wearable bands that are limited to discrete size adjustments, the clasp 110 allows a fully continuous size adjustment.

Figure 1B:
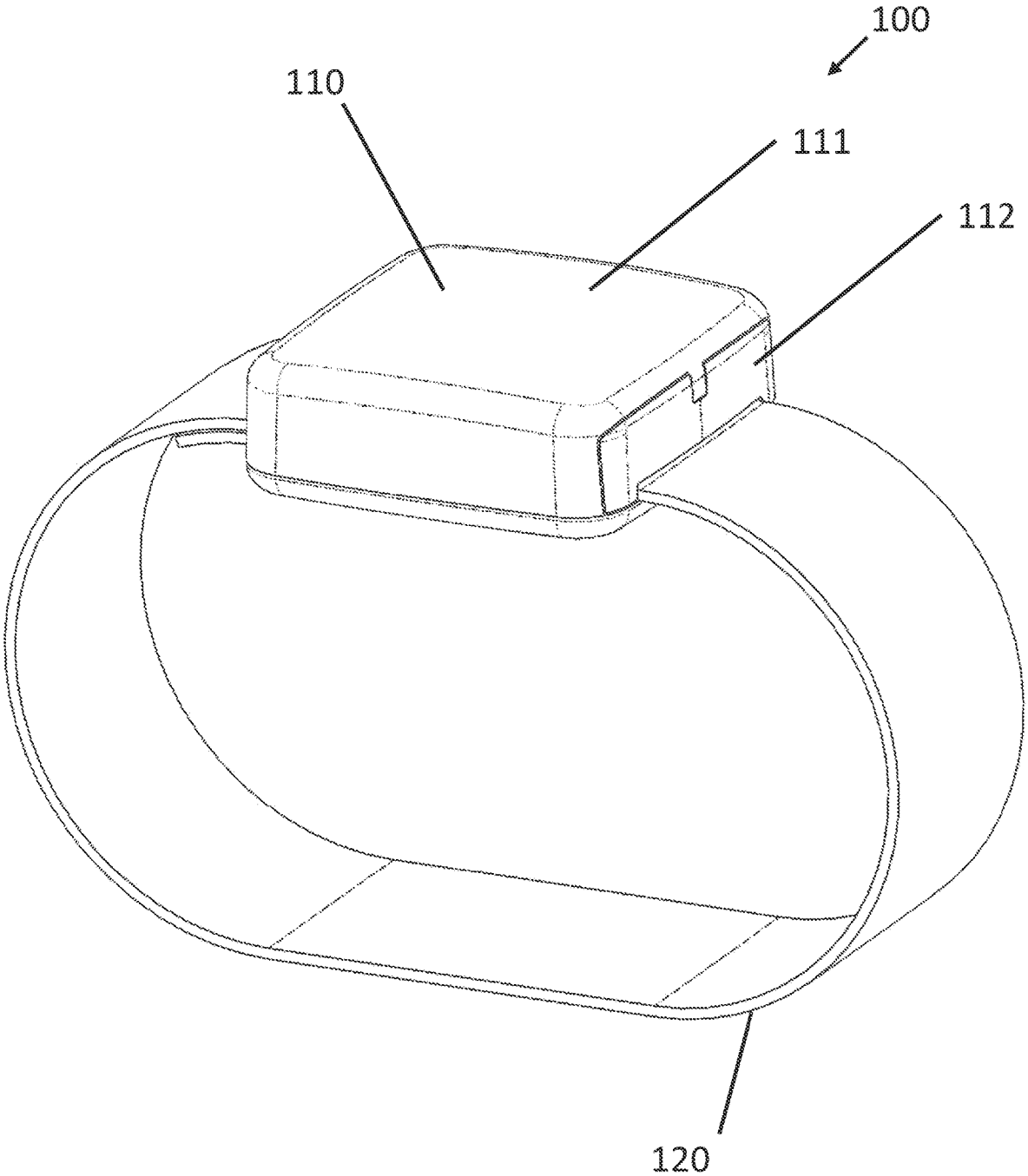
FIG. 1B shows another simplified view of the tamper-resistant wearable band of FIG. 1B.

FIG. 1B shows another simplified view of the tamper-resistant wearable band 100. In this view, the locking sled 112 has been inserted and/or slid into a second position into the outer housing cover 111 of the irreversibly locking clasp 110. When the locking sled 112 is in the second position, the clasp 110 is said to be in a second state the locks and immobilizes the strap 120. In some examples, the strap 120 may withstand 300 pounds of force or more when immobilized. In the second position, the locking sled 112 and the strap anchor may form a second path for the strap 120. The second path for the strap 120 is described in more detail below in conjunction with FIGS. 8 and 9.

When the locking sled 112 is fully inserted into the outer housing cover 111, the exterior of the irreversibly locking clasp 110 may be relatively smooth. That is, the clasp 110 may have smooth corners, edges, and relatively thin seams. These exterior features of the clasp 110 may provide little or no elements that may be subject to attack by tools such as screw drivers, knives, pliers, or the like, thereby enhancing the tamper-resistant features of the tamper-resistant wearable band 100.

In some examples, the irreversibly locking clasp 110 may have overall dimensions of approximately 30 millimeters (mm)×30 mm×10 mm. Such dimensions may enhance the wearer's comfort.

Figure 2:
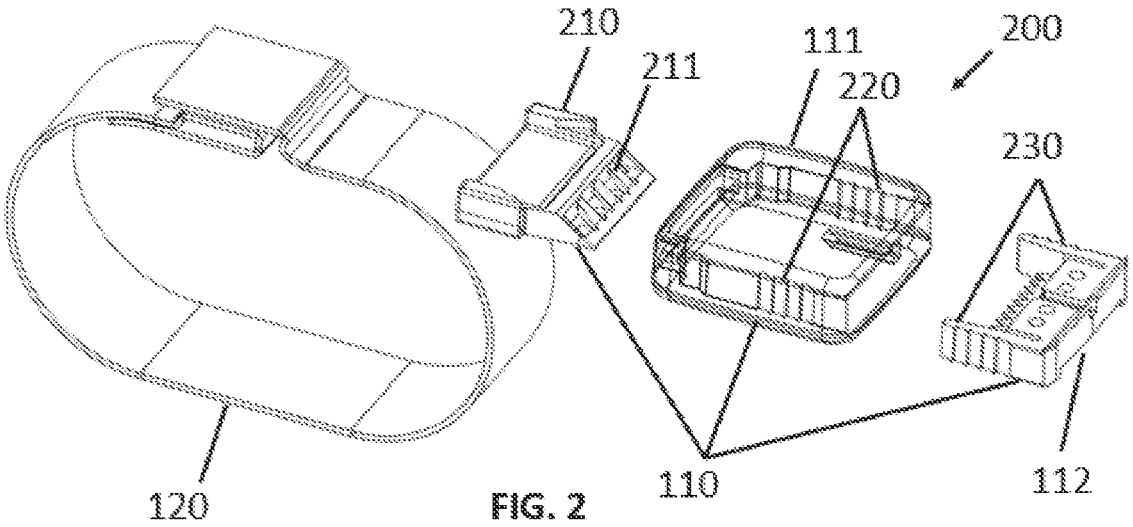
FIG. 2 shows an exploded view of the tamper-resistant wearable band of FIG. 1, according to some examples.

FIG. 2 shows an exploded view 200 of the tamper-resistant wearable band of FIG. 1, according to some examples. In this view, the strap 120 is shown separate from the clasp 110. The irreversibly locking clasp 110 is shown exploded and may include the outer housing cover 111, the locking sled 112, and a strap anchor 210.

The outer housing cover 111 may include teeth 220 that are formed or molded into sides of an internal cavity. The locking sled 112 may include pawls 230 (or gears, rack, etc.) that may engage with the teeth 220. In some examples, the teeth 220 and the pawls 230 (e.g., gears) may enable the locking sled 112 to be inserted into (e.g., slideably coupled with), but not withdrawn from, the outer housing cover 111. In other words, the locking sled 112 may be held in place and restricted to travel in only one direction. Thus, after the locking sled 112 is inserted in the outer housing cover 111, the locking sled 112 may not be removed locking the tamper-resistant wearable band into place.

The outer housing cover 111 and the locking sled 112 may be composed of or from any feasible material, including polyoxymethylene, polycarbonate, polyethylene teraphalate, polybutylene teraphalate, polyamide, and polyphenylene ether. In some examples, the material for the outer housing cover 111 and the locking sled 112 may be strong and have a high elastic elongation. In some examples the clasp may be made entirely of metal or alternatively just a portion of the clasp (e.g., the outer shell region may be metal).

The strap anchor 210 may include a ramp 211 that, together with the outer housing cover 111 and the locking sled 112 may form a path for the strap 120 (path not shown)

within the clasp 110. The paths for the straps are described in more detail below in conjunction with FIGS. 6A-9.

Figure 3A:
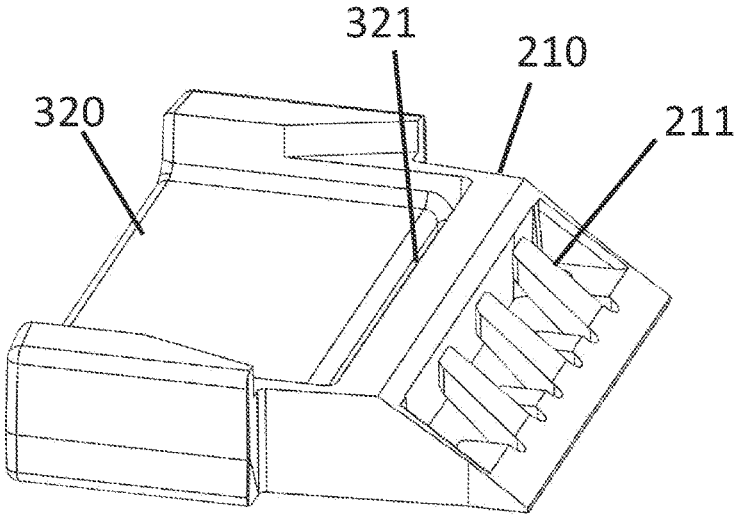
FIG. 3A shows a perspective view of one example of an inner anchor of a tamper-resistant wearable band as described herein.

FIG. 3A shows a first view of the strap anchor 210 of FIG. 2. The strap anchor 210 may fit within the outer housing cover 111 of the irreversibly locking clasp 110 of FIG. 1. In some examples, the strap anchor 210 may provide a means for anchoring the first end 121 of the strap 120 to the clasp 110. The strap anchor 210 may include ramp 211 and an anchor bar 320. The first end of the strap is looped around the anchor bar 320 and may be secured to itself, e.g., by laser welding, or by some other permanent manner.

The ramp 211 may form, in part, a path for the strap within the irreversibly locking clasp 110. A ramp angle of the ramp 211 may affect the ease of the feeding of the strap 120 through the clasp 110. For example, a shallow ramp angle may enable the strap 120 to be easily fed through the clasp 110 but may extend or increase the size of the outer housing cover 111. On the other hand, a steep ramp angle may make the insertion and feeding of the strap 120 more difficult. In some examples, the ramp angle may be approximately 35 degrees. In some other examples, the ramp angle may be between 45 and 65 degrees.

In some examples, the ramp 211 may fold or deform when, for example, receiving a force or pressure. In some cases, the ramp 211 may be formed by teeth, fingers, or other projections.

Figure 3B:
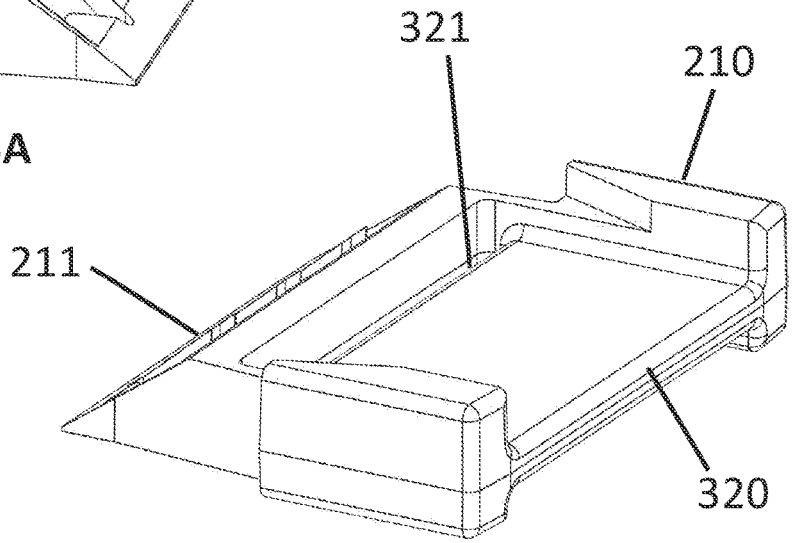
FIG. 3B shows a second perspective view of the inner anchor of FIG. 2.

The anchor bar 320 may provide a feature on the strap anchor 210 that the strap 120 can wrap around and form a loop. For example, the strap anchor 210 may include a slot 321 next to the anchor bar 320. The slot 321 may be wide enough to accommodate the width of the strap 120. FIG. 3B shows a second view of the strap anchor 210. As shown, the strap anchor 210 may include the ramp 211, the anchor bar 320 and the slot 321.

Figure 4:
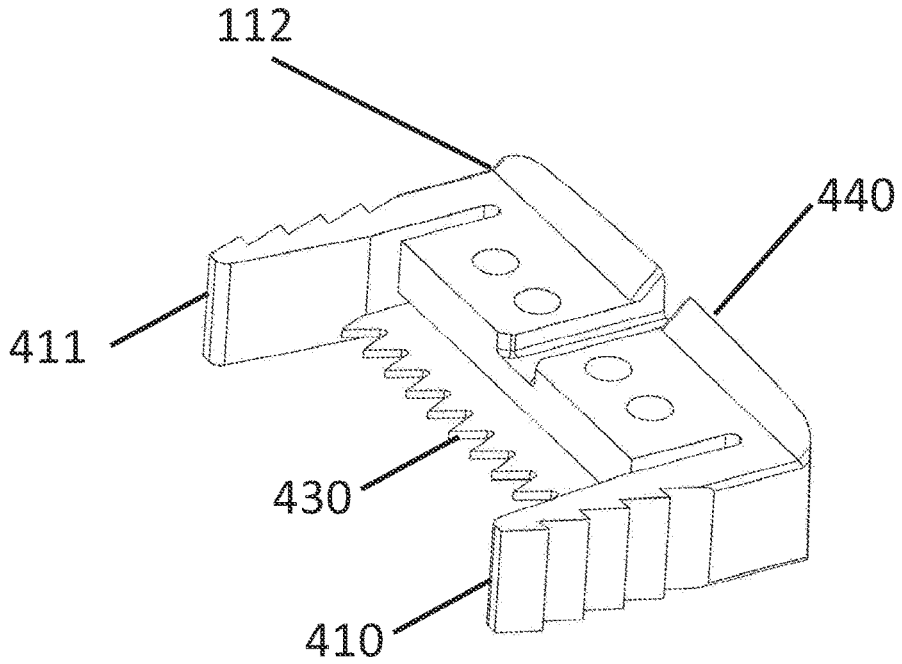
FIG. 4 shows an example of a locking sled of a tamper-resistant wearable band as described herein.

FIG. 4 shows a view of the locking sled 112 of FIG. 1, according to some examples. The locking sled 112 may include a first pawl arm 410, a second pawl arm 411, strap teeth 430, and outer surface 440. The first and second pawls arms 410, 411 may be flexible and engage with the teeth 220 of the outer housing cover 111 (teeth 220 and outer housing cover 111 not shown). In some examples, the first and second pawls arms 410, 411 may enable the locking sled 112 to be inserted into, but not withdrawn from, the outer housing cover 111. The strap teeth 430 may engage with (e.g., penetrate) and immobilize the strap 120 when the locking sled 112 is in the second position within the outer housing cover 111. In some cases, the strap 120 may be immobilized by friction between the strap teeth 430 and the ramp 211 (not shown). The strap teeth 430 may be metal or may be formed from any other feasible material. In some examples, the strap teeth 430 may have a 60 degree angle, although any feasible angle is contemplated. Furthermore, when the locking sled is in the second position, the outer surface 440 may be flush with an outer surface of the outer housing cover 111.

Figure 5:
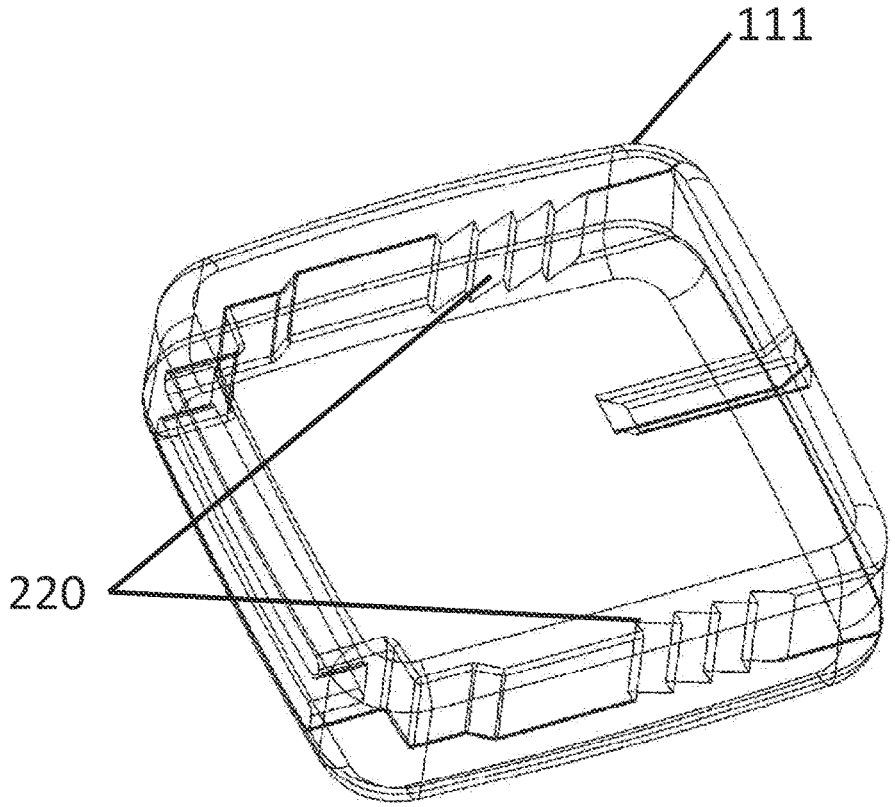
FIG. 5 shows an example of a housing of a tamper-resistant wearable band (shown transparent).

FIG. 5 shows an internal view of the outer housing cover 111 of FIG. 1. As shown, the outer housing cover 111 may include teeth 220 that can engage with the first and second pawl arms 410, 411 of the locking sled 112 (not shown).

Figure 6A:
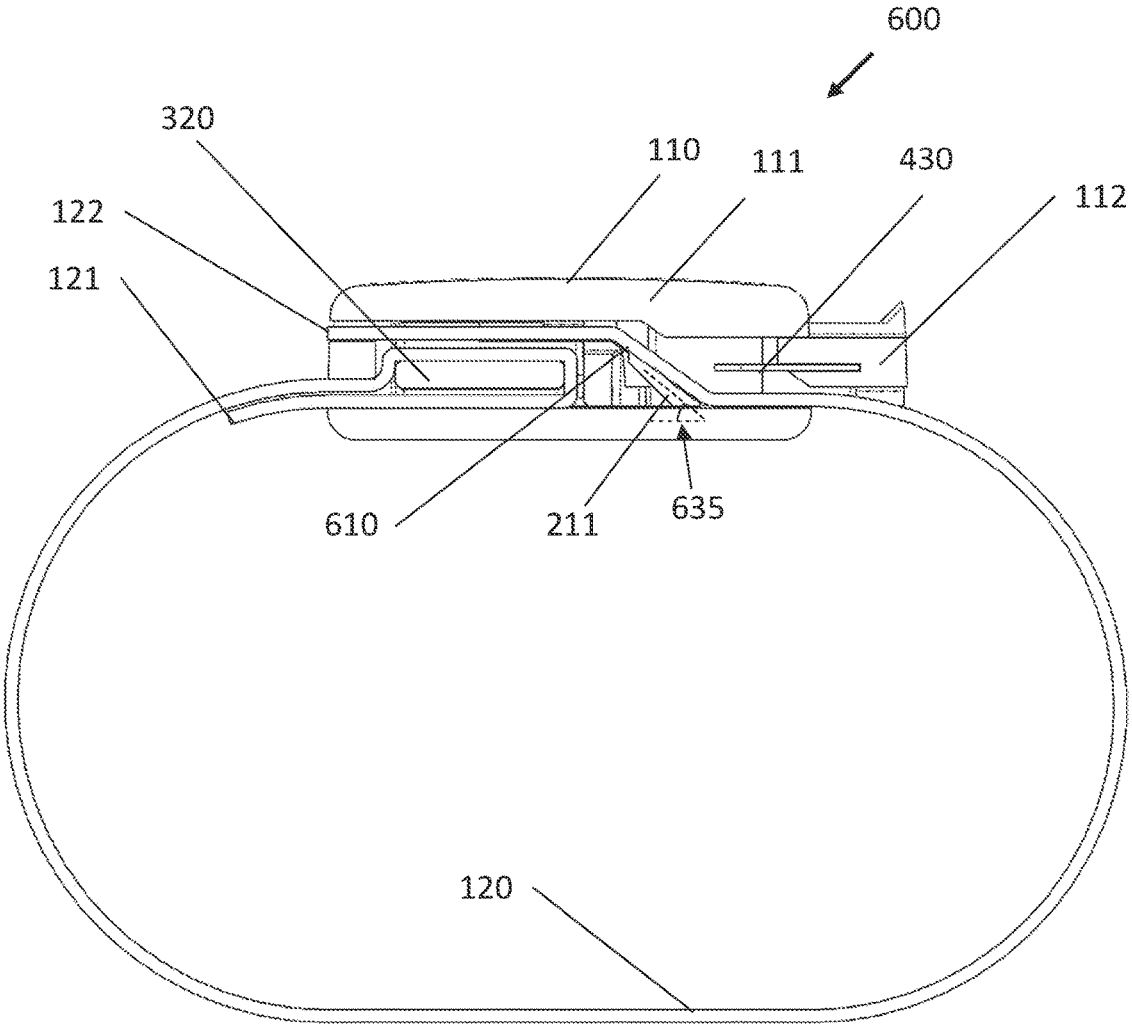
FIG. 6A shows a cut-away view of one example of a tamper-resistant wearable band similar to FIG. 1 in the first state (in which the clasp is not secured, so that the length of the strap may be adjusted).

FIG. 6A shows a cut-away view 600 of the tamper-resistant wearable band 100 of FIG. 1 in the first state, according to some examples. As shown, the irreversibly locking clasp 110 may include the outer housing cover 111, the locking sled 112, and the strap anchor 210. The first end 121 of the strap 120 may form a loop around the anchor bar 320 and may be mechanically attached to itself to close the loop.

The sliding lock 112 may be inserted into the outer housing cover 111 to a first position. While in the first position, the outer housing cover 111, the sliding lock 112, and the strap anchor 210 may form a first path 610 for the strap 120. For example, the ramp 211 and the sliding lock 112 may guide the second end 122 of the strap 120 within the outer housing cover 111. In the first state, the strap 120 may move back and forth freely within the outer housing cover 111. As shown, the strap teeth 430 may not engage with the strap 120.

Figure 6B:
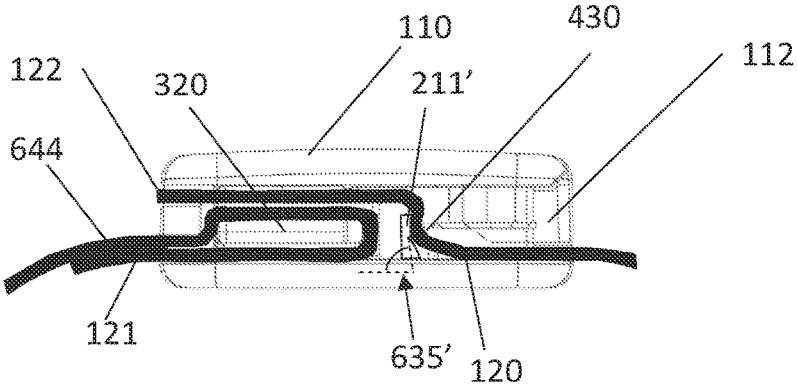
FIG. 6B shows a section through the tamper-resistant wearable band of FIG. 6A in a second state, in which the locking sled is engaged with the inner anchor within the housing so that the clasp is irreversibly secured closed, preventing the strap from sliding in or out.
Figure 6C:
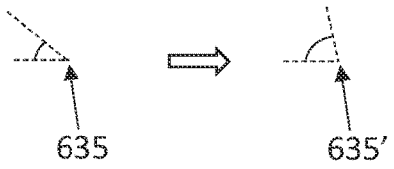
FIG. 6C illustrates the change in the angle of the ramp (or ramp members) between the first state (on the left) and the second state (on the right).

FIG. 6B shows a section through the same wearable strap of FIG. 6A in a second state, in which the sliding lock 112 is fully engaged with the inner anchor so that the teeth 430 of the sliding lock 112 drive against the strap 120 and deform the ramp 211 from a first configuration in which the angle of the ramp (e.g., the angle of the outer surface of wedge-shaped outer edge forming the ramp) within the channel is increased, e.g., from a relatively low angle of between about 10 degrees to 40 degrees (e.g., less than 45 degrees, 40 degrees or less, 35 degrees or less, etc.) to a steeper angle of between about 45 degrees and 90 degrees (e.g., between about 50 and 90 degrees, between about 55 degrees and 90 degrees, 45 degrees or greater 50 degrees or greater, 55 degrees or greater, 60 degrees or greater, etc.). FIG. 6C illustrates the change in the effective angle 635, 635' of the ramp 211, 211'.

The change in configuration of the angle of the ramp may be achieved by deforming the ramp or ramp members, or by crushing the ramp or ramp members. The resulting increase in the angle allows the teeth to engage with the strap at an almost perpendicular angle and changes the path of the strap within the outer housing cover channel so that it turns with a much steeper angle within the outer housing cover channel, resulting in a dramatically stronger securement of the strap within the outer housing cover, particularly as compared to examples in which the ramp does not change configuration to increase the angle.

In general the ramp portion of the inner anchor may allow the second end 121 of the strap 120, which is initially loose, to be easily inserted into the channel of the outer housing cover, and be guided, by the ramp through the channel and out the second end of the outer housing cover, particularly when the sliding lock 112 is partially inserted into the outer housing cover, as shown in FIG. 6A. Thus, the inner anchor may guide the second end of the strap up over the ramp and out of the second end of the outer housing cover before being locked down by the sliding lock member 112, as shown in FIG. 6B.

Figure 7:
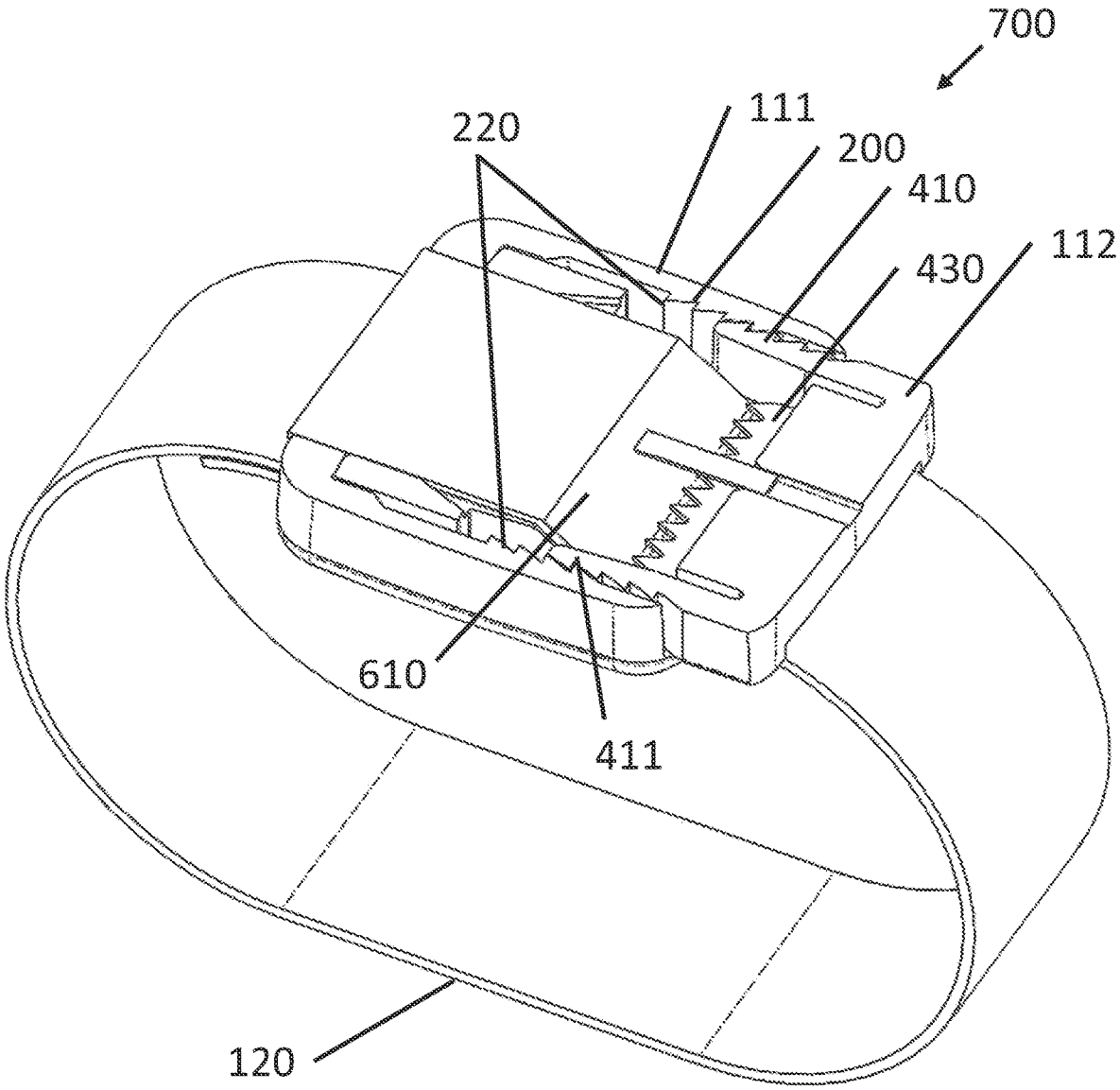
FIG. 7 shows an alternate cut-away view of the tamper-resistant wearable band of FIG. 1 with a clasp in the first (unsecured) state.

FIG. 7 shows an alternate cut-away view 700 of the tamper-resistant wearable band 100 of FIG. 1 in the first state. The sliding lock 112 may be in the first position in the outer housing cover 111. The strap 120 may follow the first path 610 for the strap 120 and the strap teeth 430 may not yet engage the strap 120. The first and second pawl arms 410 and 411 may engage with teeth 220 of the outer housing cover 111.

Figure 8:
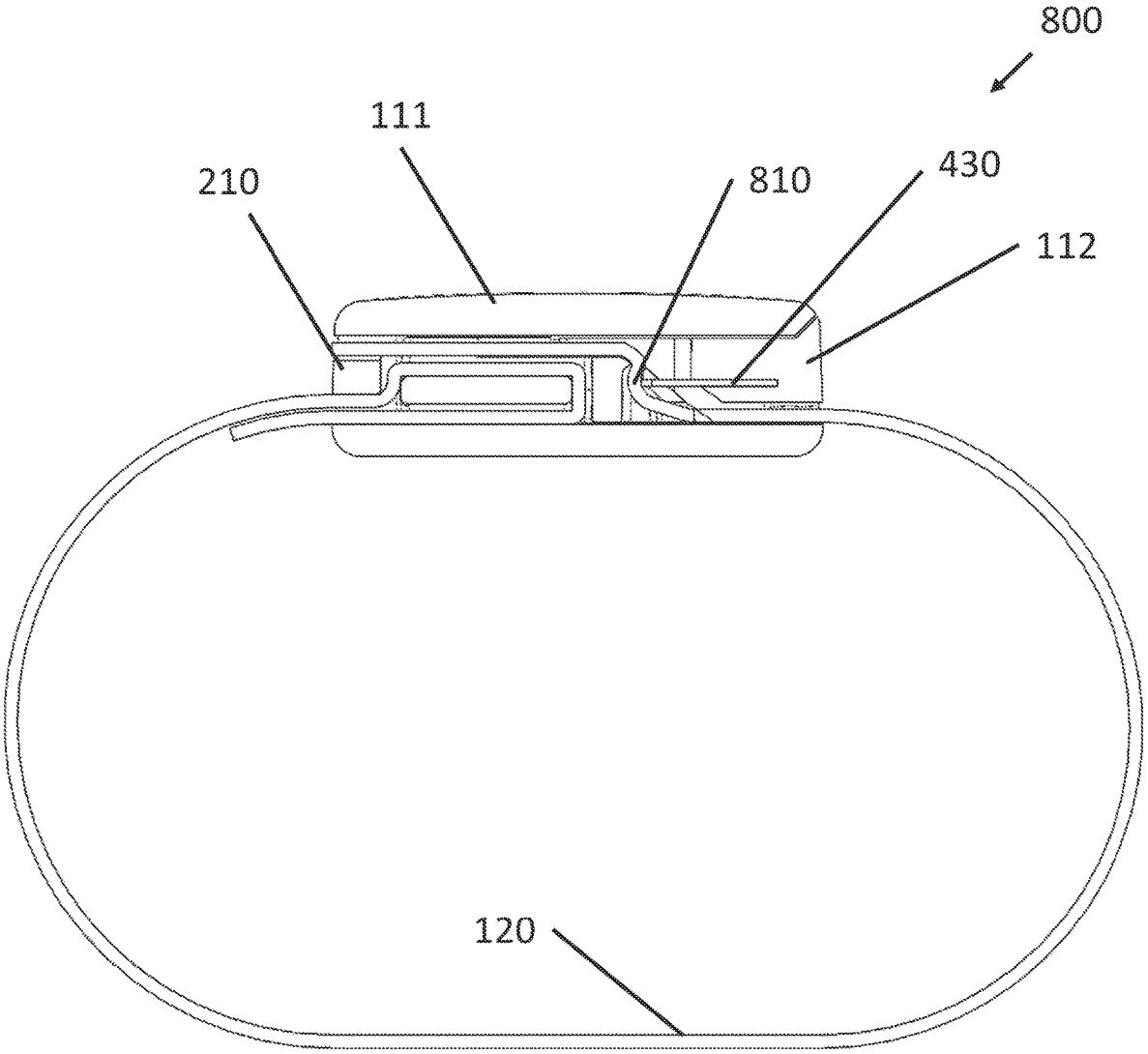
FIG. 8 shows a cut-away view of the tamper-resistant wearable band of FIG. 1 with a clasp in the second state, in accordance with some examples.

FIG. 8 shows a cut-away view 800 of the tamper-resistant wearable band 100 of FIG. 1 in the second state, in accordance with some examples. The sliding lock 112 may be inserted into the outer housing cover 111 to a second position. While in the second position, the outer housing cover 111, the sliding lock 112, and the strap anchor 210 may form a second path 810 for the strap 120. For example, strap teeth 430 may fold or deform the ramp (not shown) and engage with and immobilize the strap 120 within the outer housing cover 111. In some examples, the sliding lock 112 may directly or indirectly provide pressure to the ramp thereby causing the ramp to fold. The second path 810 for the strap 120 may no longer smoothly transition up the ramp 211, but instead have an "S" shape while being bound by the strap teeth 430. In some cases, the second path 810 may have a reverse curvature. In some examples, the second path 810 for the strap 120 may form an 80-90 degree angle in the strap 120.

Figure 9:
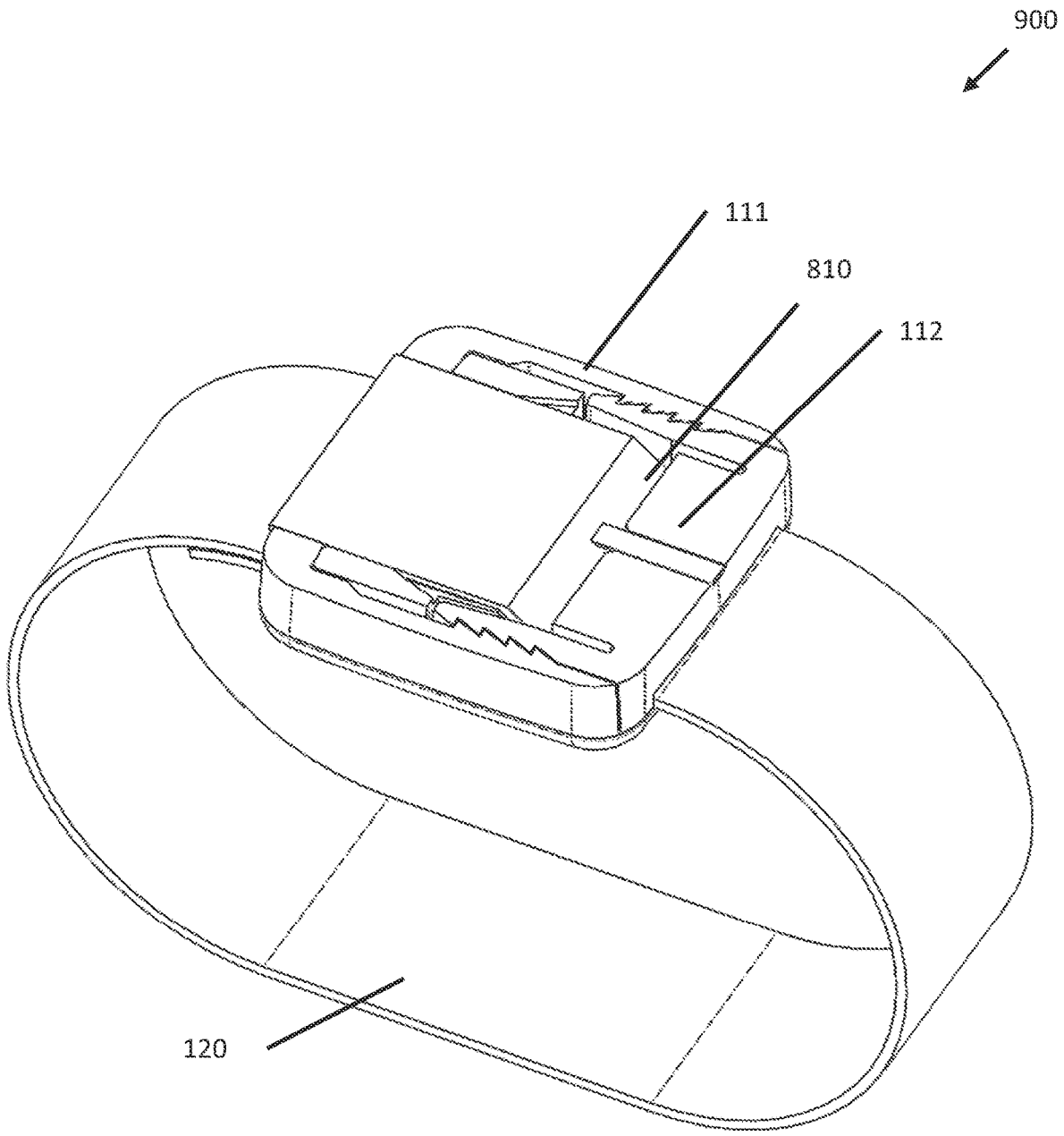
FIG. 9 shows an alternate cut-away view of the tamper-resistant wearable band of FIG. 1 with a clasp in the second (secured) state.

FIG. 9 shows an alternate cut-away view 900 of the tamper-resistant wearable band 100 of FIG. 1 in the second state. The sliding lock 112 may be in the second position in the outer housing cover 111. The strap 120 may follow the second path 810 for the strap 120 and the strap teeth (not shown) may engage and/or penetrate the strap 120.

Figure 10:
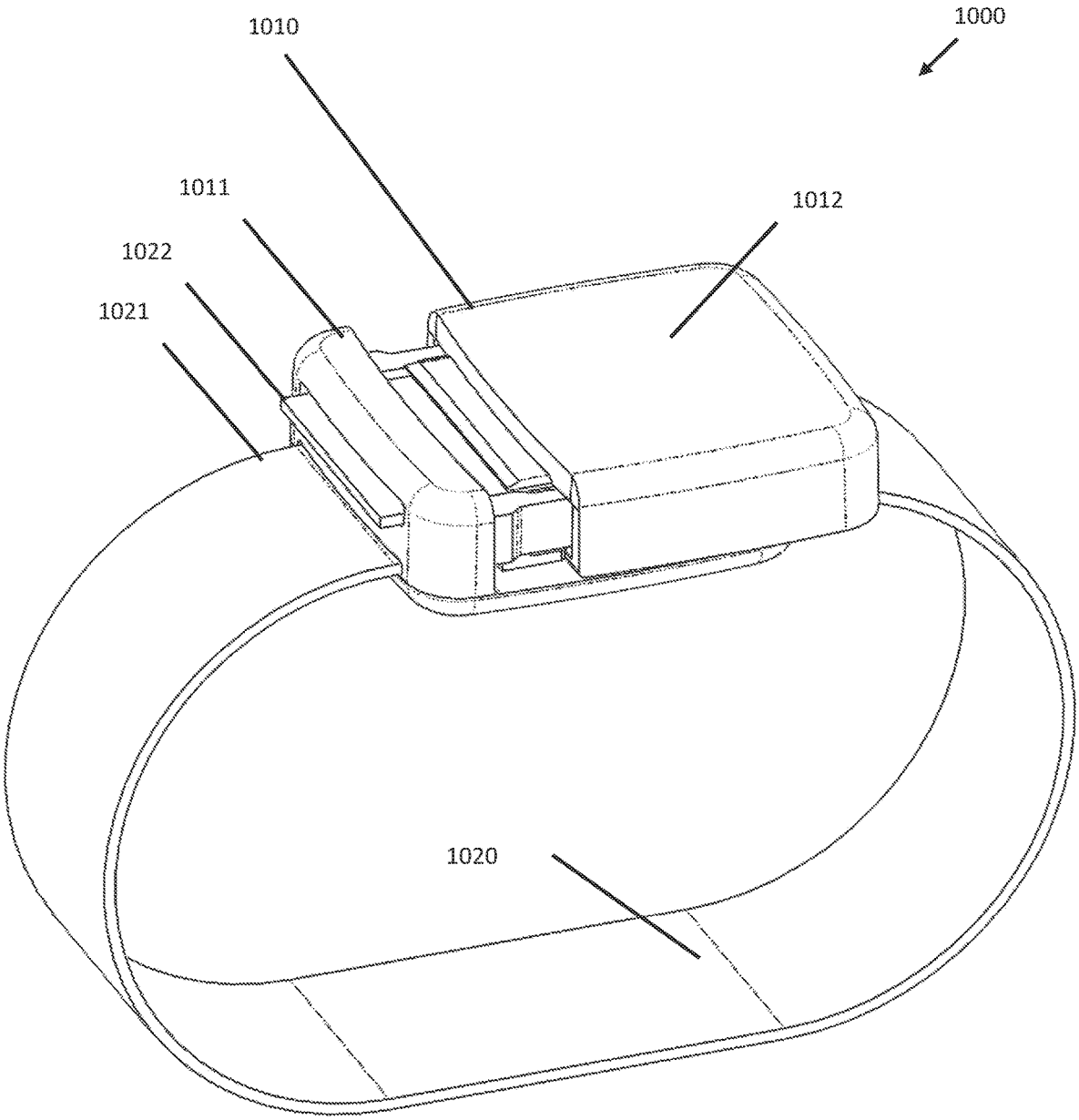
FIG. 10 shows a simplified view of a tamper-resistant wearable band, according to some examples.

FIG. 10 shows a simplified view of a tamper-resistant wearable band 1000, according to some examples. The tamper-resistant wearable band 1000 may include an irreversibly locking clasp 1010 and a strap 1020. The strap 1020 may include a first end 1021 and a second end 1022. The strap 1020 may be another example of the strap 120 of FIG. 1.

The irreversibly locking clasp 1010 may include a base 1011 and a cover 1012. The base 1011 may anchor the first end 1021 of the strap 1020. FIG. 10 shows the tamper-resistant wearable band 1000 in a first state that allows the strap 1020 to move freely and be adjusted back and forth through the clasp 1010.

Figure 11:
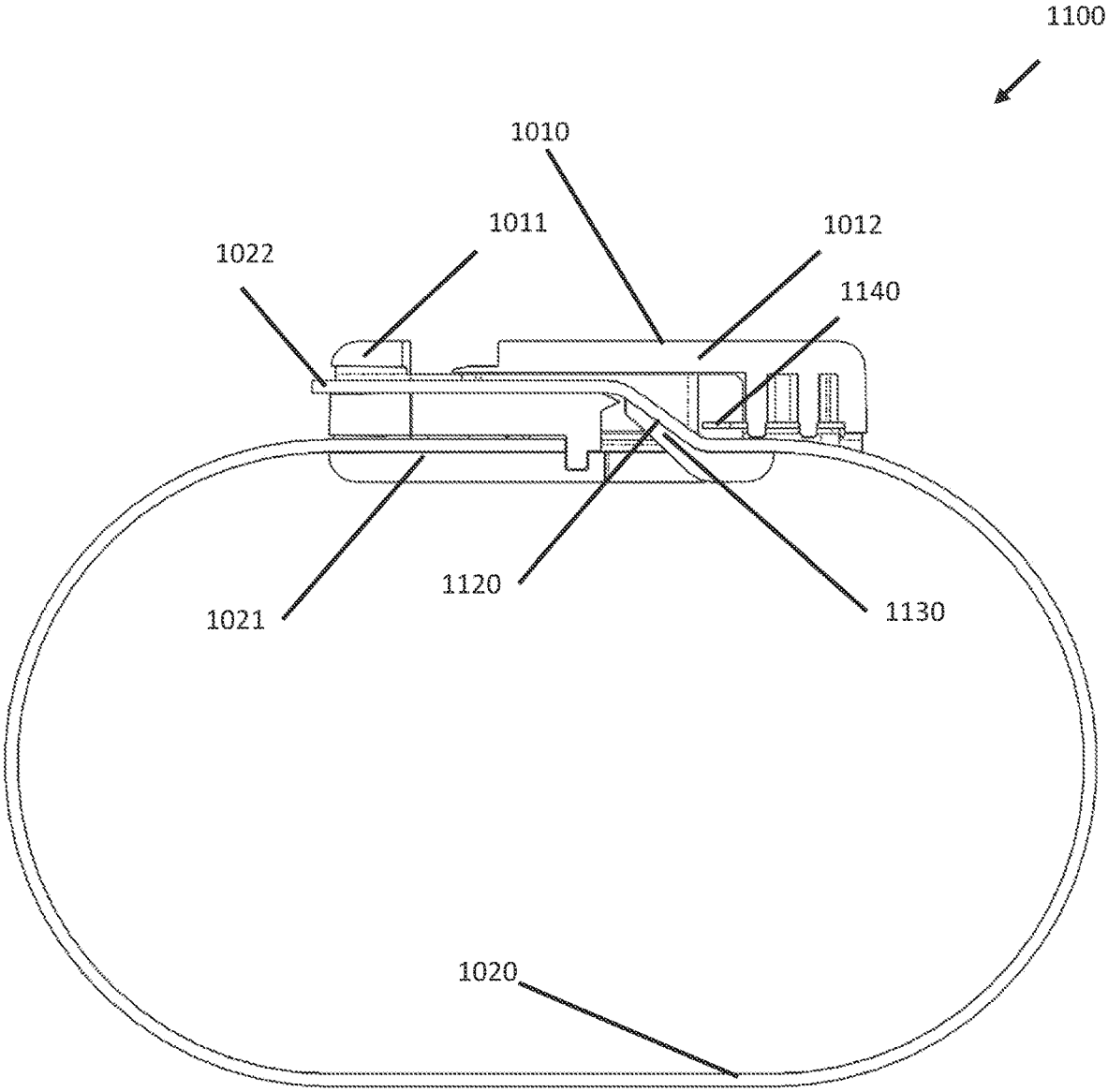
FIG. 11 shows a cut-away view of an example of a tamper-resistant wearable band with a clasp in the first (unsecured) state, according to some examples.

FIG. 11 shows a cut-away view 1100 of the tamper-resistant wearable band 1000 in the first state, according to some examples. As shown, the irreversibly locking clasp 1010 may include the base 1011 and the cover 1012. The first end 1021 of the strap 1020 may be anchored or otherwise attached to the base 1011. In the first state, the base 1011 and the cover 1012 may form a first path 1120 for the strap 1020. Furthermore, in the first state the cover 1012 may be in a first position with respect to the base 1011. In some examples, the base 1011 may include a ramp 1130 that may form, at least in part, the first path 1120 for the strap 1020. Furthermore, the cover 1012 may include strap teeth 1140 that may not engage with the strap 1020 while the tamper-resistant wearable band 1000 is in the first state. Thus, while in the first state, the strap 1020 may move freely within the clasp 1010.

The cover 1012 may be slideably coupled to the base 1011. In some examples, the base 1011 and the cover 1012 may include one or more teeth and pawls (not shown) respectively, that enable the base 1011 and the cover 1012 to move and lock into a second position.

Figure 12:
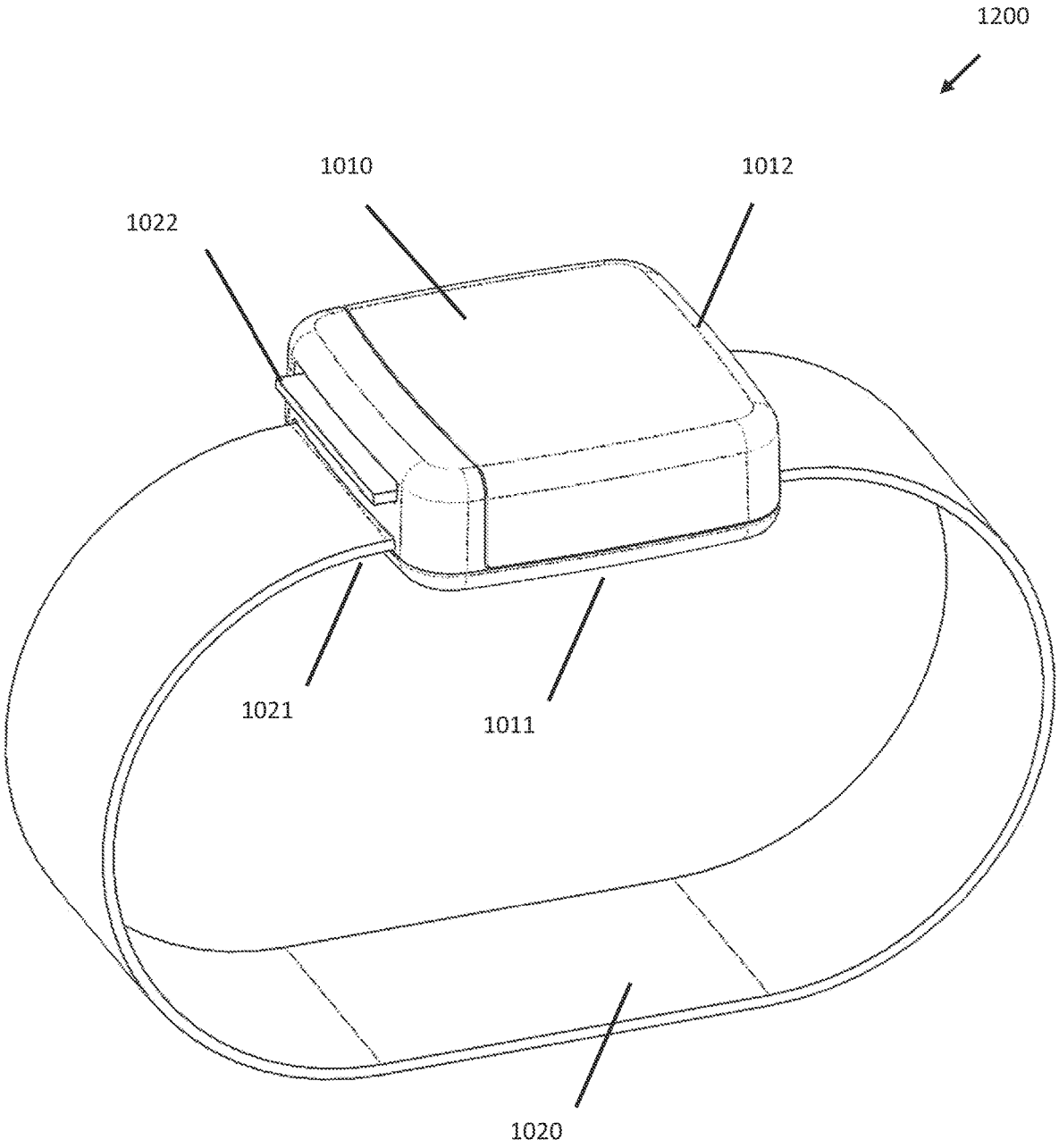
FIG. 12 shows another simplified view of a tamper-resistant wearable band of FIGS. 10 and 11, according to some examples.

FIG. 12 shows another simplified view 1200 of the tamper-resistant wearable band 1000 of FIGS. 10 and 11, according to some examples. In this view, the cover 1012 has been moved into a second position with respect to the base 1011. The strap 1020 has the first end 1021 anchored by the base 1011 and the second end 1022 immobilized by the cover 1012. When the cover 1012 is in the second position, the tamper-resistant wearable band 1000 is said to be in a second state where the strap 1020 is locked and immobilized.

Figure 13:
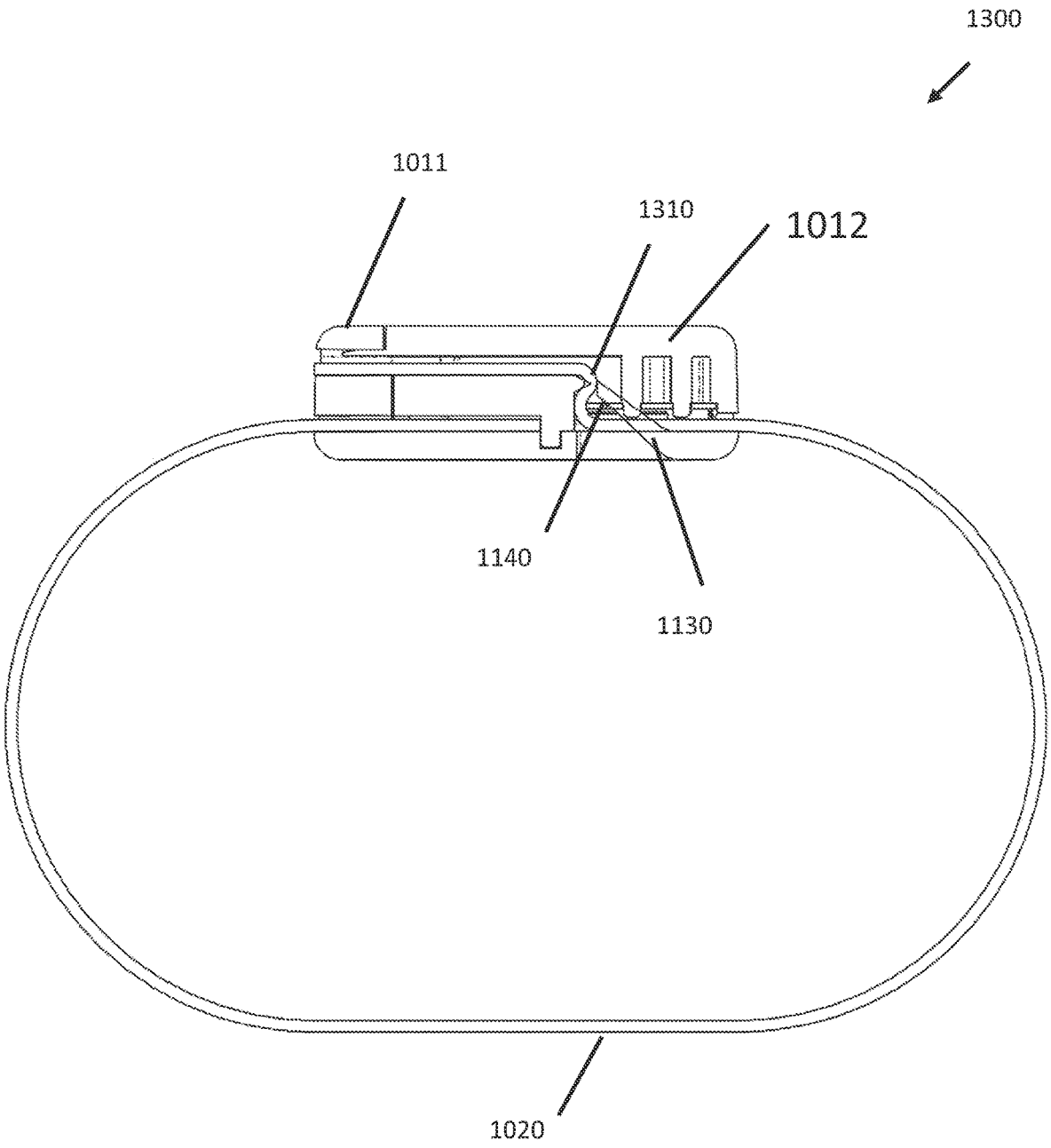
FIG. 13 shows a cut-away view of the tamper-resistant wearable band with a clasp in the second state, according to some examples.

FIG. 13 shows a cut-away view 1300 of the tamper-resistant wearable band 1000 in the second state, according to some examples. As shown, the cover 1012 is in the second position forcing the strap teeth 1140 to engage and/or penetrate the strap 1020 and fold or deform the ramp 1130. In some examples, the cover 1012 may directly or indirectly provide pressure to the ramp 1130 thereby causing the ramp 1130 to fold or the effective angle of the ramp (the angle that the strap takes against the ramp) increasing from an initial angle to a larger angle. Thus, the base 1011 and the cover 1012 may form a second path 1310 for the strap 1020 while the tamper-resistant wearable band 1000 is in the second state. Therefore, in the second state the cover 1012 may be in a second position with respect to the base 1011. In some examples, the second path 1310 for the strap 1020 may have an "S" shape and/or a reverse curvature.

In some examples, the ramp may deform by introducing one or more projecting arms or teeth through the projection forming the ramp. Thus, although the ramp itself may not bend or deflect, the ramp deforms by adding additional ramping elements that have a larger effective angle. In some examples the additional ramp projections may be inserted through the ramp from the locking sled.

As mentioned above, these apparatuses may be used for any method, system or apparatus that may benefit from a tamper-resistant strap or band. For example, the apparatuses and methods described herein may be useful for securing a tracking and/or monitoring device to a subject (e.g., a patient) including a psychiatric patient, a penal subject, etc. These methods and apparatuses (e.g., devices, systems) can be used for coupling a tracking and/or monitoring device in any appropriate setting, including hospital ward, managed care facility, psychiatric ward, etc. these apparatuses may be used in a care setting and/or a residential setting, for example, for monitoring subjects with dementia, subjects who are intellectually and developmentally disabled (IDD), etc.

Any of the apparatuses described herein may be configured to include or be used with one or more monitoring and/or tracking components. See, e.g., U.S. Pat. No. 10,896,590, U.S. patent application publication no. U.S. 2021/0166544 and PCT/US2020/050548, herein incorporated by reference in their entirety. In any of these apparatuses, the apparatus may include an integrated tracking and/or monitoring device within, e.g., the irreversibly locking clasp. For example, the clasp may include a housing or chamber enclosing the tracking and/or monitoring components, including power (e.g., battery), control circuitry, wireless circuitry, and the like.

In any of these examples, the apparatus may include a patient identification tag that uses low energy Bluetooth technology. For example, a patient identification tag may include a body portion that is attached to the strap (or alternatively the clasp may for the body portion), The clasp and/or a separate body portion may include a Bluetooth low energy (BLE) RFID beacon device that can transmit a signal (e.g., a signal having a 360° range of about 10 to 20 feet from the device in some non-limiting examples). A battery and battery holder may also be included. The battery may be electrically connected to a BLE RFID beacon portion. Thus, in some examples the apparatus may include a patient identification tag that is integrated into the clasp, including integrated into a specific chamber within the clasp. For example the clasp may include (in the outer housing cover or within an inner anchor within the housing cover) a chamber holding a Bluetooth low energy circuit board for use as a patient identification tag; a flexible active circuit board may include a transmission component.

In general, any of these apparatuses may include a clasp that has more than one ramp/sled feature. For example an apparatus may include two ramp/sled features instead of one (as described above), which may allow for infinite adjustment from both ends using an infinite band or two entirely separate bands. Thus, these apparatuses may be configured as a bi-clasp.

Figure 14A:
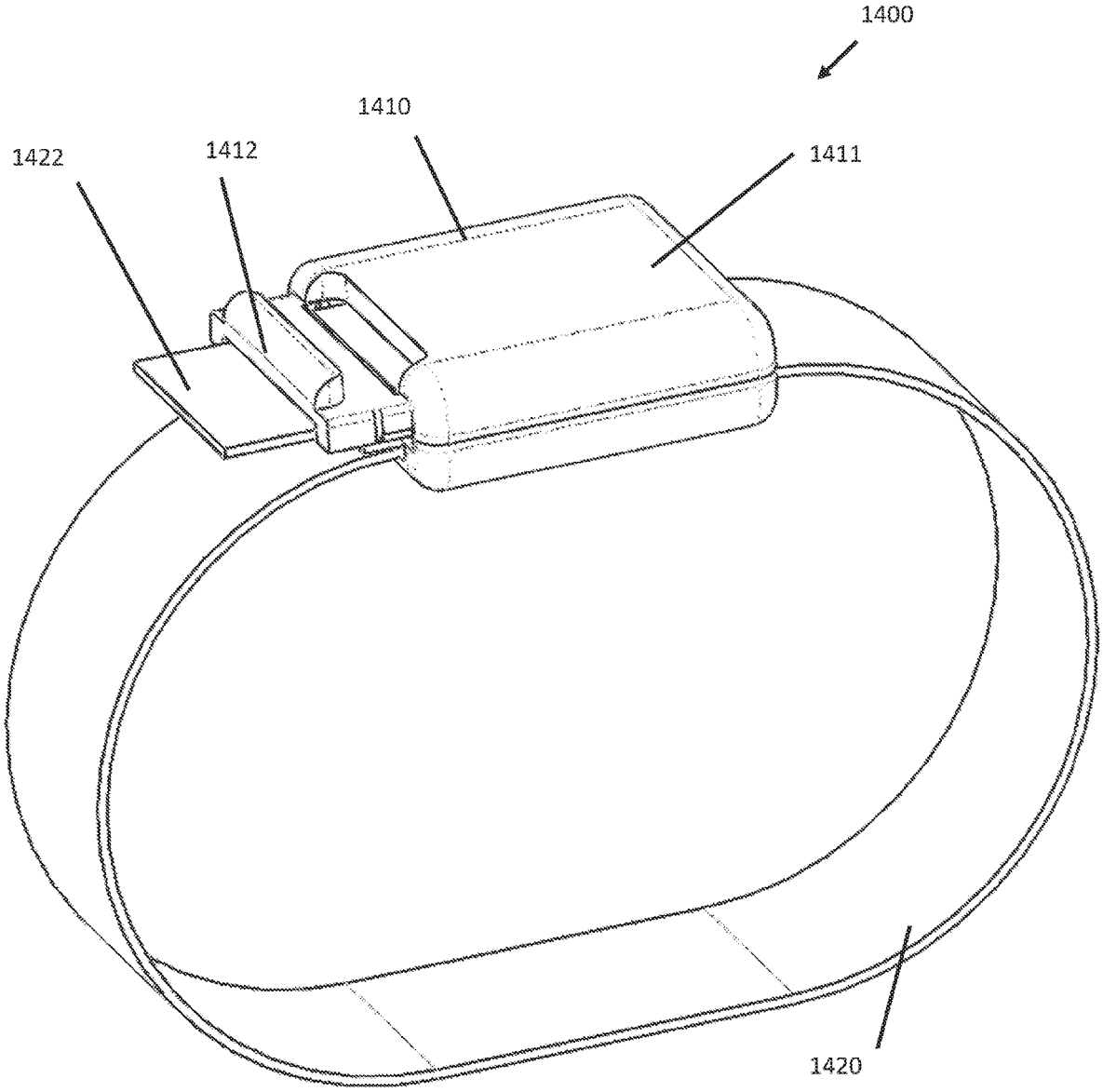
FIG. 14A shows another example of a tamper-resistant wearable band in an unlocked configuration.
Figure 14B:
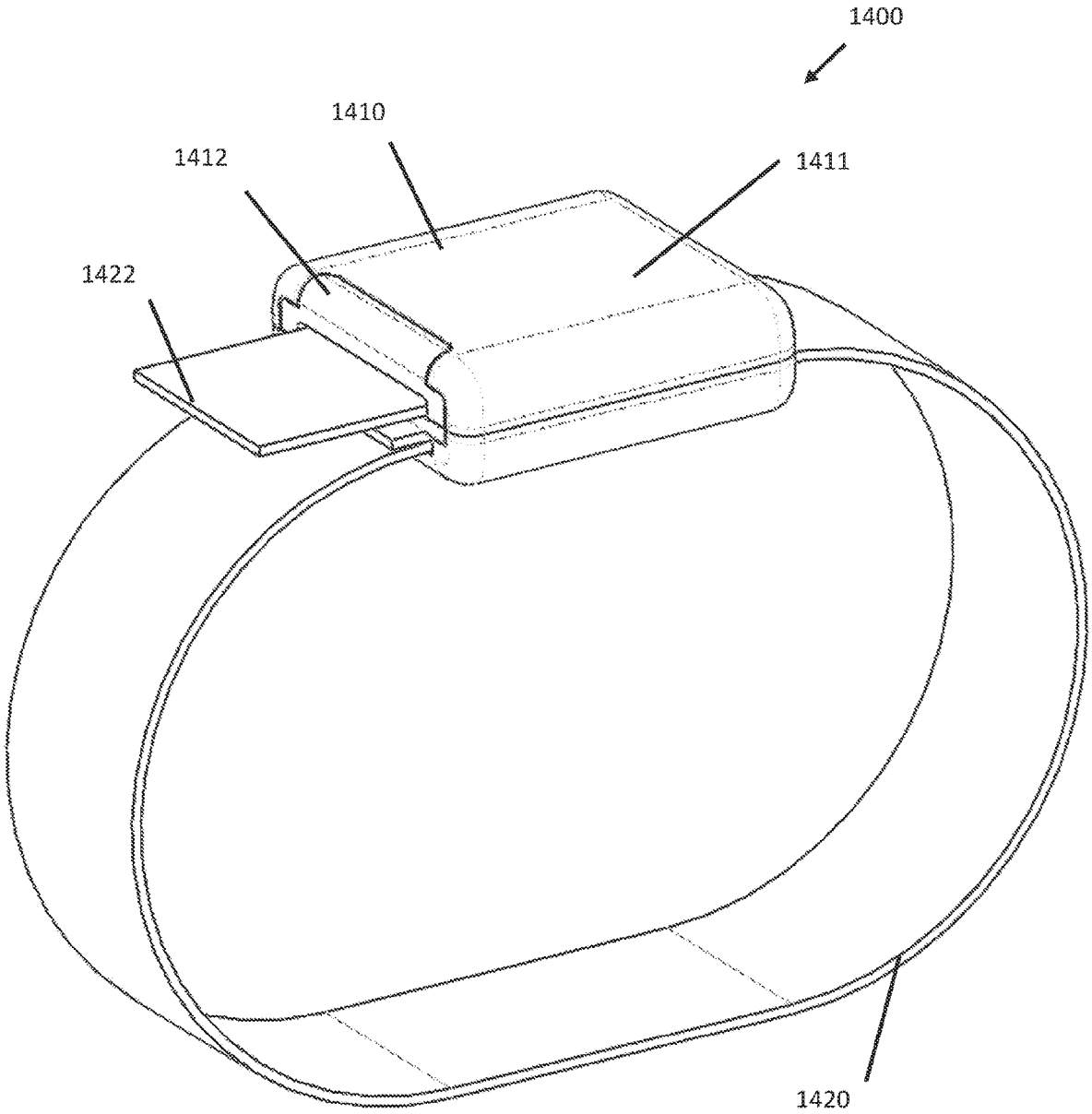
FIG. 14B is another view of the tamper-resistant wearable band of FIG. 14A in a locked configuration.

FIGS. 14A and 14B illustrate another example of a tamper-resistant wearable band 1400, according to some examples. The tamper-resistant wearable band 1400 may include an irreversibly locking clasp 1410 and a strap 1420. The clasp 1410 may include an outer housing cover 1411, a locking sled 1412 and a strap anchor (not visible in FIG. 14A), The strap 1420 may include a first end and a second end. In FIG. 14A, the tamper-resistant wearable band 1400 is shown with the locking sled in a first configuration, not fully engaged with the outer housing, so that the second end of the strap 1422 can be moved relative to the clasps, to enlarge or reduce the diameter of the loop of the strap. Thus, the device may be freely tightened or loosened. Once the strap size is positioned at the desired diameter, the locking sled 1412 may be driven fully into the housing 1411 and locked in place, securing the strap, As shown in FIG. 14B. The portion of the second end of the strap 1422 extending out of the clasp may be cut or trimmed.

In this example, similar to that shown in FIGS. 10-13, the internal ramp is formed as part of an inner anchor (or inner anchor member) and has an angle of between about 30 and 45 degrees.

Figure 15A:
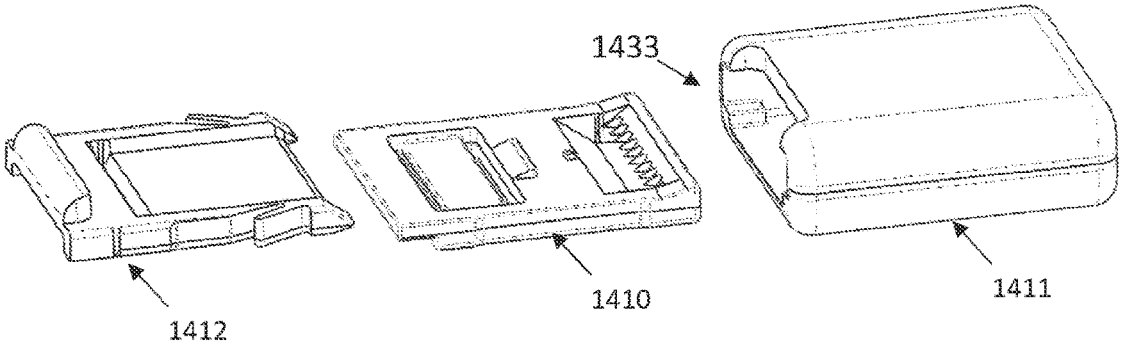
FIGS. 15A-15D illustrate components of a tamper-resistant wearable band similar to that of FIGS. 14A-14B.
Figure 15B:
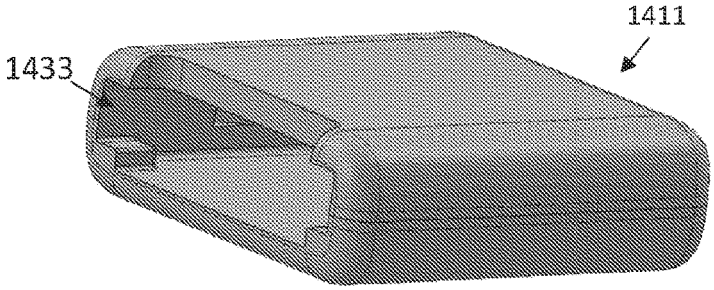

FIGS. 15A-15D illustrate the components of the irreversible locking clasp of FIGS. 14A-14B. For example, FIG. 15A shows an exploded view with the component parts disassembled, including an outer housing cover 1411 having a first open end 1433, an inner anchor 1410 and a locking sled 1412. FIG. 15B shows a slightly enlarged perspective view of the outer housing. In this example the outer housing is single piece that includes a smooth outer surface and an inner surface that may include one or more engagement surfaces for engaging and retaining either or both the inner anchor and the locking sled.

Figure 15C:
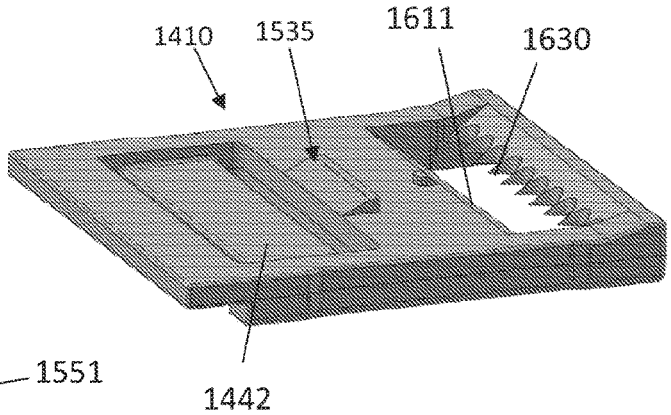

FIG. 15C shows an enlarged perspective view of the inner anchor member 1410. In this example the inner anchor includes a ramp having a first ramp angle and a strap retaining or anchoring bar 1442. The inner anchor member 1410 also includes a set of teeth 1630 that are positioned opposite from the ramp. When the inner anchor member is secured within the outer housing cover 1411 the ramp faces the second end opening and the teeth face away from the second end opening. The inner anchor member 1410 may also include one or more securements for engaging with the inner region of the housing cover. In any of these examples the apparatus also includes one or more attachments 1535 for securing to the locking sled 1412, in order to lock the locking sled in position when it is fully inserted into the outer housing cover 1411.

In the example shown in FIG. 15C the inner anchor integrates the teeth, ramp and anchoring bar; in some examples these features may be separate from each other (e.g., the inner anchor may be two or more separate or separable components. The inner anchor, and in particular the teeth 1630 may be formed of a metal and/or polymeric material that is relatively rigid. In the example shown in FIGS. 14A-14B and 15C, the inner anchor including the ramp, teeth and anchoring bar are formed of a metal such as zinc. In this example, zinc is particularly advantageous because it cannot hold an edge, but has otherwise desirable mechanical properties. The inability of zinc to maintain a sharp edge may be particularly useful for devices that are to be used in a carceral setting.

Figure 15D:
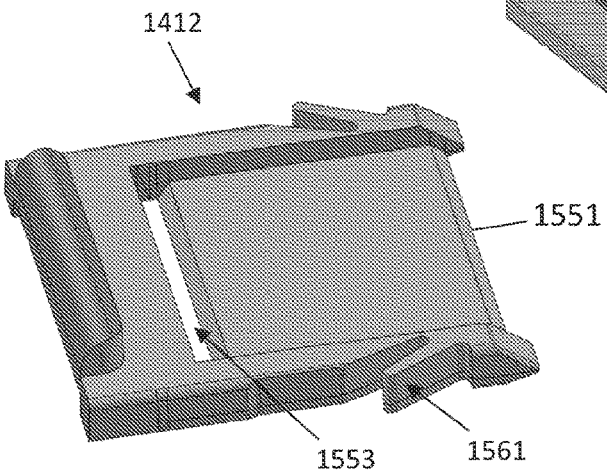

FIG. 15D shows an example of a locking sled as described herein. In FIG. 15D the locking sled 1412 includes a second ramp 1551, as well as an opening 1553 through which the strap may be passed. The locking sled may also include one or more gears 1561 that may engage with a rack or other structure within the outer housing cover to prevent the locking sled from withdrawing from the outer housing cover. In any of these examples the clasp is configured so that the strap may be held (by friction) within the clasp but may be adjusted to increase or decrease the loop size of the strap. A minimal amount of friction may hold the strap relative to the clasp while still allowing it to be adjusted by the application of minimal force. In the examples shown in FIGS. 14A-14B and 15A-15D the path taken by the strap through the inner anchor member and over and through the lock sled 1553 provides sufficient resistance (frictional resistance) to movement of the strap to prevent slipping, but allows for relatively easy readjustment of the strap.

Figure 16A:
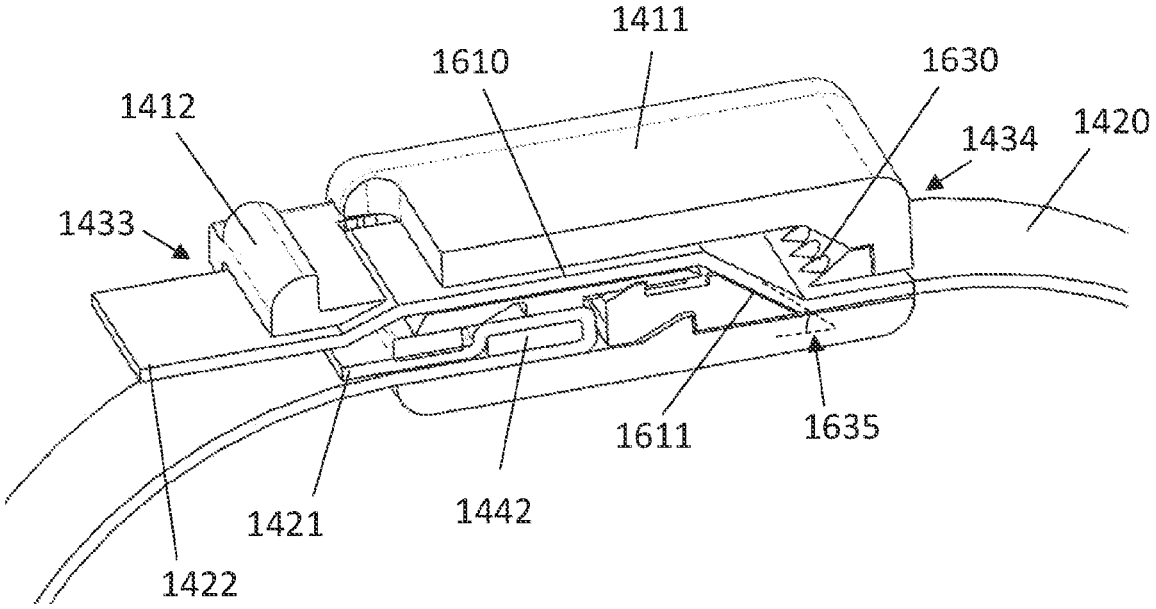
FIGS. 16A-16B are sectional views through the tamper-resistant wearable band of FIGS. 14A and 14B.
Figure 16B:
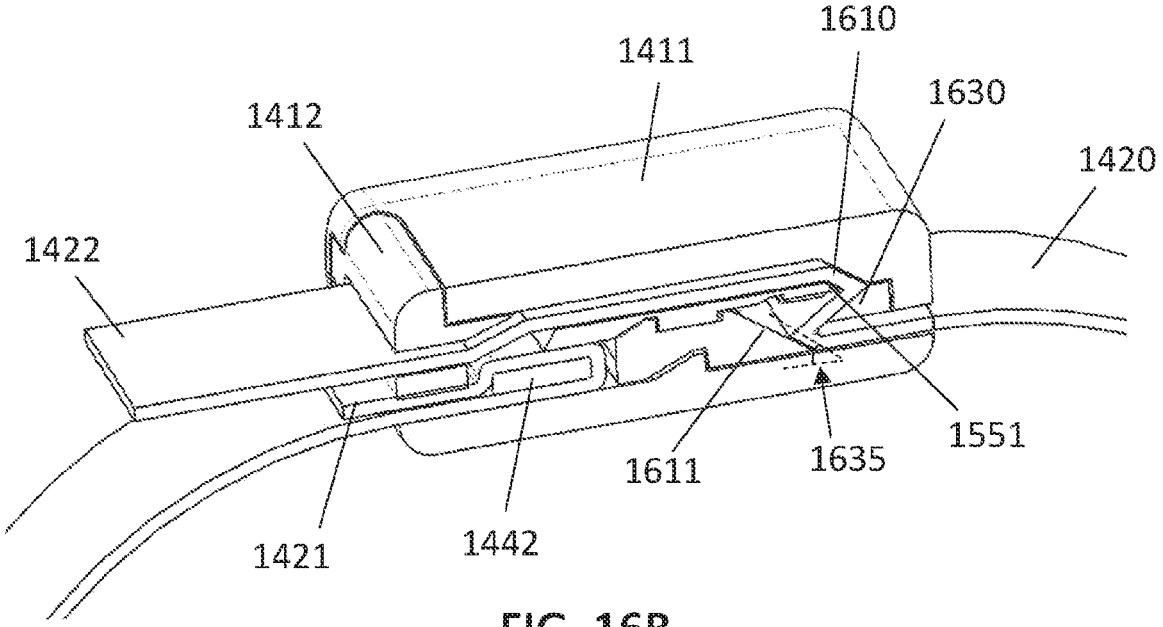
Figure 17:
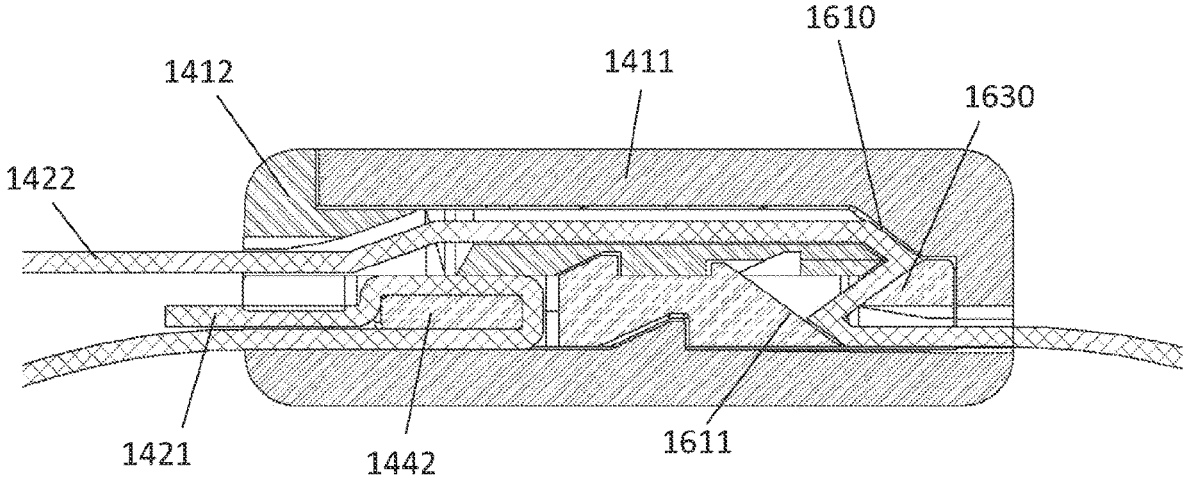
FIG. 17 is a sectional view through a clasps of a tamper-resistant wearable band in a secured configuration, similar to that shown in FIGS. 14B and 16B.

FIGS. 16A-16B show a section through the apparatus of FIGS. 14A and 14B, respectively. In this example the apparatus includes the flexible strap 1420 having a first end 1421 and a second end 1422 that are secure by the irreversibly locking clasp. The irreversibly locking clasp includes an outer housing cover 1411 that is open at a first open end 1433 and a second open end 1434. The first end of the strap is attached to an inner anchor (e.g., to an anchoring bar 1442 of the inner anchor) and held within the outer housing cover. In this example the inner anchor also includes a ramp 1611 having a first angle 1635 forming a first path 1610 for the strap through the clasp. In the unengaged configuration the path 1610 allows the strap to pass freely and continuously through the clasp, including through an opening of the locking sled 1412. The locking sled 1412 is coupled to the outer housing cover 1411 at the first open end so that the second end of the flexible strap may pass into the second open end, over and along the ramp, and through the locking sled. The clasp also include an internal set of (one or more) teeth 1630 that are positioned opposite the ramp and facing away from the second open end. In FIG. 16A the strap 1420 over the ramp 1611 at a first angle 1635 and does not engage with the teeth 1630 when the locking sled is not fully engaged. However, as shown in FIG. 16B when the locking sled is driven fully into the housing 1411, the locking sled 1412 pushes the portion of the strap within the housing against the one or more teeth, so that the path 1610 for the strap changes from the ramp angle 1635 to a much larger angle; in FIG. 16B the path extends at an angle that is greater than 90 degrees, having a s-shaped path 1610 with a reverse curvature. Thus, the locking sled 1412 slides and locks the clasp to alter the path of the strap so that the strap reverses direction in the clasp and is further retained by the one or more sharp teeth.

In general, the apparatuses described herein can be fully pre-assembled prior to putting the device on a patient's wrist. For example, the apparatus may be assembled from a minimal assembly of multiple pieces (e.g., strap, outer housing cover, inner anchor, locking sled) and may be easily and rapidly applied to a patient's wrist without requiring training. This may be particularly advantageous in busy settings (e.g., such as an emergency room setting), and may also be important when dealing with anxious, violent or paranoid patients. These methods may prevent delays and difficulties in assembly. This apparatuses described herein may be fully assembled into a loop such that all that is required is to slip the loop over a patient's limb, slide to adjust for sizing and then, locking the band permanently in place. As mentioned, the locking step (e.g., fully inserting the locking sled into the outer housing cover, may be performed without changing the size of the loop of the band during the locking process. In some cases the loop may be pre-assembled and later adjusted up/down in size when applied to the patient.

In general, the apparatuses described herein may include a band that is continuously adjustable and does not require any holes representing adjustment positions. As mentioned above, this may also permit the band material to be relatively smooth and comfortable; for example, the band may be woven and may have a relatively soft and/or smooth texture. Thus, the apparatuses described herein may work well with even smooth, flat weaves that are otherwise relatively harder to grip.

Furthermore, the apparatuses described herein may be configured so that they are relatively easy to close and lock, so that very low closing force is required to lock them, when driving the locking sled into the outer housing cover. In general, the configurations described herein may be closed by applying less than 20 N of force (e.g., 20 N or less, 18 N or less, 17 N or less, 16 N or less, 15 N or less, 14 N or less, 12 N or less, 10 N or less, 9 N or less, 8 N or less, 7 N or less, 5 N or less, 4 N or less, 3 N or less, 2 N or less, etc. In contrast, the apparatuses described herein, and in particular the variation shown in FIGS. 14A-14B, 15A-15D and 16A-16B have a very high pull-out strength. As mentioned, the arraignment of the locking sled and inner anchor (including the ramp and one or more teeth) results in further engaging the strap against the one or more teeth. For example, the pull-out force may be greater than 650 N (e.g., greater than 150 lbs.-force).

It should be appreciated that all combinations of the foregoing concepts and additional concepts discussed in greater detail below (provided such concepts are not mutually inconsistent) are contemplated as being part of the inventive subject matter disclosed herein and may be used to achieve the benefits described herein.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various example methods described and/or illustrated herein may also omit one or more of the steps described or illustrated herein or include additional steps in addition to those disclosed.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments only and is not intended to be limiting of the invention. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings of the present invention.

In general, any of the apparatuses and methods described herein should be understood to be inclusive, but all or a sub-set of the components and/or steps may alternatively be exclusive, and may be expressed as "consisting of" or alternatively "consisting essentially of" the various components, steps, sub-components or sub-steps.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes may be made to various embodiments without departing from the scope of the invention as described by the claims. For example, the order in which various described method steps are performed may often be changed in alternative embodiments, and in other alternative embodiments one or more method steps may be skipped altogether. Optional features of various device and system embodiments may be included in some embodiments and not in others. Therefore, the foregoing description is provided primarily for exemplary purposes and should not be interpreted to limit the scope of the invention as it is set forth in the claims.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A tamper-resistant wearable band comprising:

a flexible strap including a first end and a second end; and an irreversibly locking clasp including:

an outer housing cover having a first open end opposite a second open end and a channel formed therebetween;

an inner anchor and a ramp having a first ramp angle, wherein the first end of the flexible strap is secured to the inner anchor and wherein the flexible strap extends from the inner anchor and out of the first open end, further wherein the inner anchor is configured to be retained within the outer housing cover so that the ramp faces the second open end of the outer housing;

one or more teeth positioned opposite the ramp and facing away from the second open end; and a locking sled slideably coupled to the outer housing cover at the first open end so that the second end of the flexible strap may pass into the second open end, over and along the ramp, and through the locking sled;

wherein the locking sled is configured to be driven into the outer housing cover from the first open end to drive the flexible strap against the one or more teeth so that a path of the flexible strap changes from an initial angle along the ramp to a larger angle to lock the flexible strap relative to the outer housing cover, further wherein the locking sled is locked between the outer housing cover and the inner anchor.

2. The tamper-resistant wearable band of claim 1, wherein the path of the flexible strap is changed from the initial angle to an S-shape path having a reverse curvature.

3. The tamper-resistant wearable band of claim 1, wherein the one or more teeth are integrated with the inner anchor.

4. The tamper-resistant wearable band of claim 1, wherein a length of the flexible strap extending from the second open end of the outer housing cover does not shorten when the locking sled is driven into the outer housing cover to lock the flexible strap relative to the outer housing cover.

5. The tamper-resistant wearable band of claim 1, wherein the inner anchor further comprises an anchor bar and the first end of the flexible strap is secured around the anchor bar.

6. The tamper-resistant wearable band of claim 5, wherein the first end of the flexible strap is welded to itself around the anchor bar.

7. The tamper-resistant wearable band of claim 5, wherein the first end of the flexible strap forms a loop in which the first end of the flexible strap is secured to itself by one of adhesives, sewing, heat welding, ultrasonic welding, or a combination thereof.

8. The tamper-resistant wearable band of claim 1, wherein the initial angle is 40 degrees or less, and wherein the larger angle is 45 degrees or more.

9. The tamper-resistant wearable band of claim 1, wherein the locking sled is configured to travel in only one direction with respect to the outer housing cover.

10. The tamper-resistant wearable band of claim 1, wherein the first open end has a larger width than the second open end.

11. The tamper-resistant wearable band of claim 1, wherein the locking sled includes flexible pawls configured to engage with teeth formed in the outer housing cover.

12. The tamper-resistant wearable band of claim 1, wherein the flexible strap is configured to move freely over the ramp until the locking sled is driven into the outer housing cover from the first open end to drive the flexible strap against the one or more teeth.

13. The tamper-resistant wearable band of claim 1, wherein the ramp comprises a plurality of ramp projections.

14. The tamper-resistant wearable band of claim 1, wherein the flexible strap comprises a woven polyester, a non-woven polyester, a polyamide, a polyolefin, polyolefin laminated fibers, or a combination thereof.

15. The tamper-resistant wearable band of claim 1, wherein the outer housing cover, inner anchor and locking sled each comprise at least one of a polyoxymethylene, a polycarbonate, a polyethylene teraphalate, a polybutylene teraphalate, a polyamide, a polyphenylene ether, or a combination thereof.

16. A tamper-resistant wearable band comprising:

a flexible strap including a first end and a second end; and an irreversibly locking clasp including:

an outer housing cover having a first open end opposite a second open end and a channel formed therebetween;

an inner anchor including an anchor bar and a ramp having a first ramp angle, wherein the first end of the flexible strap is welded to itself forming a loop around the anchor bar, further wherein the inner anchor is configured to be retained within the outer housing cover so that the ramp faces the second open end of the outer housing;

one or more teeth positioned opposite the ramp and facing away from the second open end; and a locking sled slideably coupled to the outer housing cover at the first open end so that the second end of the flexible strap passes over the ramp, through the locking sled and out of the first open end of the outer housing cover;

wherein the locking sled is configured to deflect the flexible strap when the locking sled is driven into the outer housing cover so that a path of the flexible strap changes from an initial angle along the ramp to a larger angle to lock the flexible strap relative to the outer housing cover, further wherein the locking sled is locked between the outer housing cover and the inner anchor.

17. A method of securing a tamper-resistant wearable band around an appendage of a subject, the method comprising:

placing a strap of the tamper-resistant wearable band around the subject's appendage, wherein a first end of the strap is secured to an anchor bar within a housing of a clasp of the tamper-resistant wearable band;

inserting a second end of the strap into a second opening into the housing of the clasp so that the second end of the strap extends over a ramp within the housing at a first angle, through a locking sled that is slidably coupled to the housing, and out of a first opening into the housing of the clasp; and irreversibly securing the strap within the housing of the clasp without changing a length of a portion of the strap extending between the first opening and the second opening by driving the locking sled into the first opening of the housing so that the strap is driven against one or more teeth within the clasp that are positioned opposite the ramp, and so that a path of the strap changes from an initial angle along the ramp to a larger angle, locking the strap relative to an outer housing cover, and locking the locking sled between the outer housing cover and an inner anchor.

18. The method of claim 17, wherein irreversibly securing the strap by driving the locking sled so that the path of the strap changes from the initial angle to a larger angle comprises changing the path of the strap to an S-shape path having a reverse curvature.

19. The method of claim 17, wherein irreversibly securing the strap by driving the locking sled so that the strap is driven against the one or more teeth comprises driving the strap against one or more teeth that are integrated into the outer housing cover.

20. The method of claim 17, wherein irreversibly securing the strap by driving the locking sled so that the path of the strap changes from the initial angle to a larger angle comprises deforming the ramp from the initial angle to a second angle.

21. The method of claim 17, wherein irreversibly securing the strap by driving the locking sled so that the path of the strap changes from the initial angle to a larger angle comprises deforming the ramp from the initial angle to a second angle, wherein the second angle is 45 degrees or more.

22. The method of claim 17, wherein driving the locking sled into the first opening comprises engaging with one or more pawls on an inside of the housing of the clasp to prevent the locking sled from retracting out of the housing.

* * * * *